United States Patent [19]

Buschor

[11] 4,123,966

[45] Nov. 7, 1978

[54] CARTON FORMING APPARATUS

[75] Inventor: Josef J. Buschor, San Jose, Calif.

[73] Assignee: Nolex Corporation, Los Angeles, Calif.

[21] Appl. No.: 749,182

[22] Filed: Dec. 8, 1976

[51] Int. Cl.[2] ..... B31B 1/30

[52] U.S. Cl. ..... 93/49 R; 93/44

[58] Field of Search ..... 93/44, 44.1 R, 36.8, 93/49 R; 53/186, 376, 377

[56] References Cited

U.S. PATENT DOCUMENTS

| | | | |
|---|---|---|---|
| 1,584,964 | 5/1926 | Wellman | 93/44 |
| 1,957,613 | 5/1934 | Richard | 93/44 |
| 2,171,418 | 8/1939 | Palmer | 93/44 |
| 2,974,571 | 3/1961 | Windstrup et al. | 93/44 X |

*Primary Examiner*—James F. Coan

*Attorney, Agent, or Firm*—Knobbe, Martens, Olson, Hubbard & Bear

[57] ABSTRACT

Apparatus for forming a sealable carton for liquids accepts from a supply station a T-shaped blank of coated sheet material that is impervious to the fluid that the carton to be formed from the blank is to contain. The blank is pre-scored to delineate the side walls and ends of the carton and is further pre-scored to delineate tabs by means of which the sealing of the carton is to be effected. The apparatus for forming the carton includes a plurality of carton blank carriers mounted on a conveyor. As the conveyor carries the blank past a first operational station the side seam sealing tab is flexed forwardly and away from the mounting plate preparatory to the formation of a side seam. Following the positioning of the mandrel the blank is wrapped around the mandrel, two of the three exposed side panels of the blank being brought into surface contact with two of the faces of the mandrel and a third being brought into a position of angular confrontation with a face of the mandrel in which position its free edge spacedly confronts the side seam sealing tab that has been flexed. The carton blank carrier next brings the blank into registry with a source of heated air directed between the flexed side seam sealing tab and the inner surface of the side panel that is confronting the sealing tab. The sealing tabs at the end of the tube that will be closed to form the bottom of the carton are brought into association with a system of rollers which flexes the three sealing tabs toward positions where they may be engaged by the closure panel of the tube that has been left exposed by the mandrel. The carton blank carrier next transports the carton past a source of heat which is directed on the outer surfaces of the sealing tabs and the inner surface of the closure panel that has been brought into proximity to the sealing tabs. Following completion of the closure of one end of the carton the mandrel is withdrawn and the open-ended carton is released from the blank carrier for storing or for delivery of the carton to carton filling equipment.

19 Claims, 44 Drawing Figures

FIG. 1.
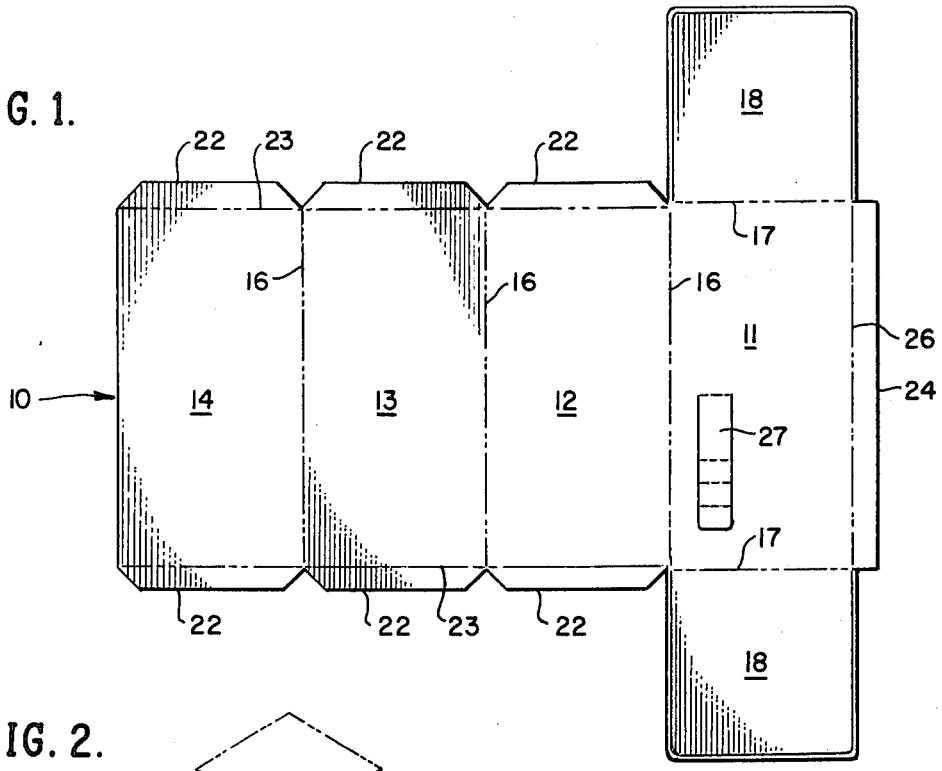
FIG. 2.
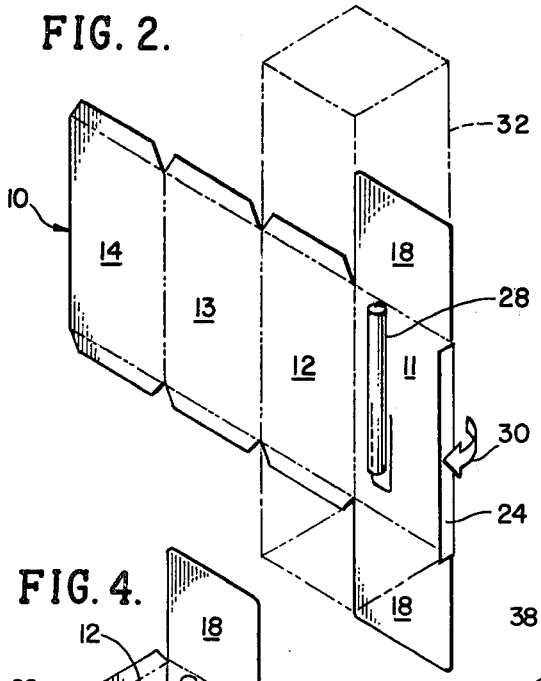
FIG. 3.
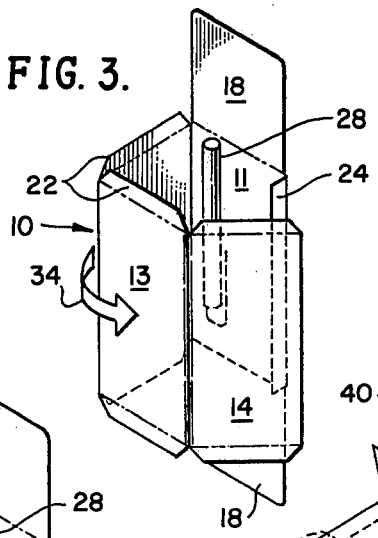
FIG. 4.
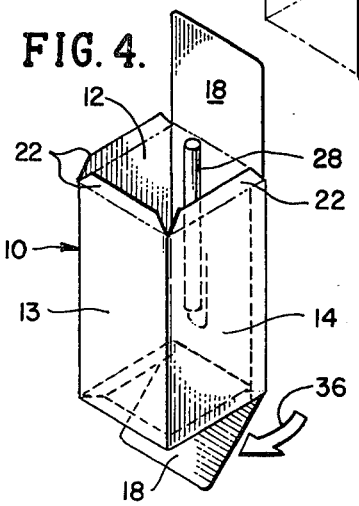
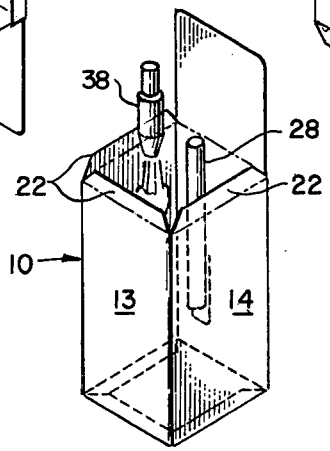
FIG. 5.
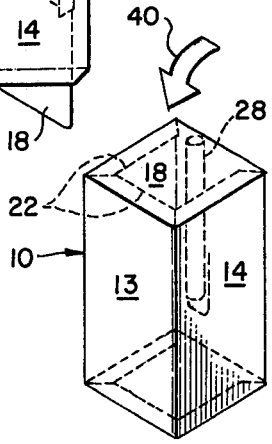
FIG. 6.

FIG. 15.
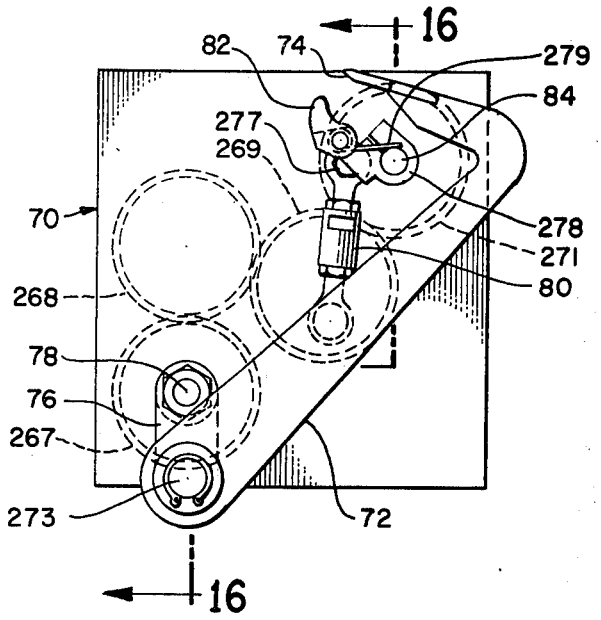
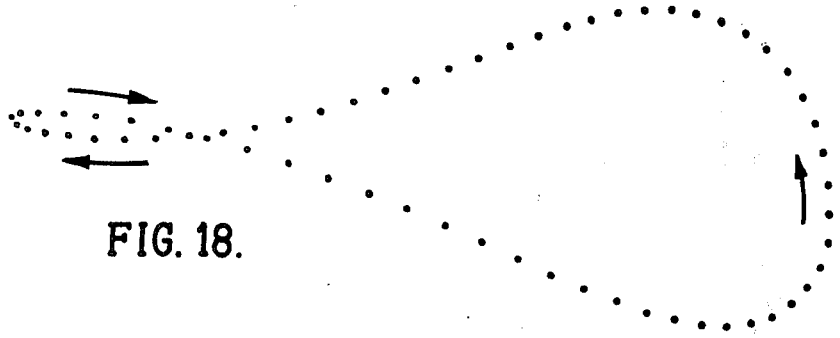
FIG. 18.
FIG. 19.
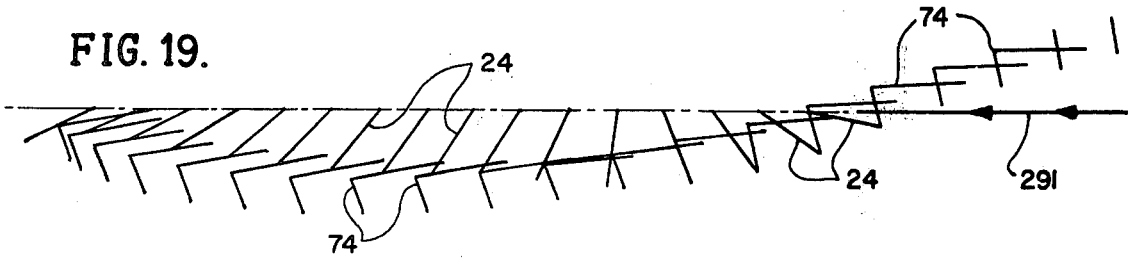
FIG. 16.
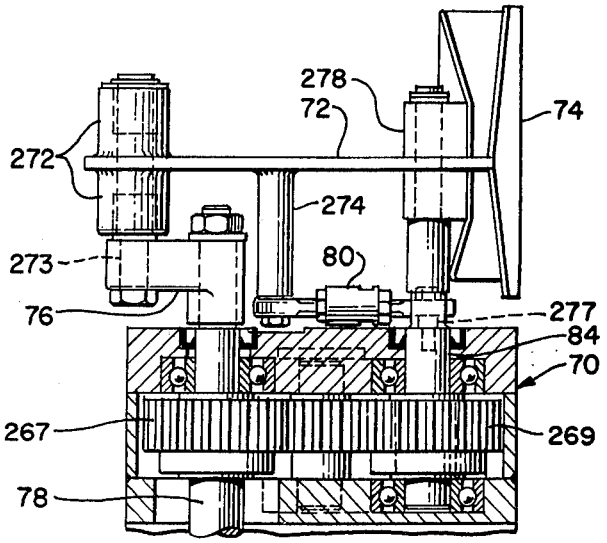
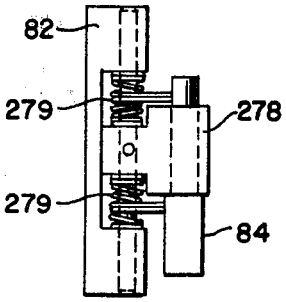
FIG. 17.

FIG. 30.
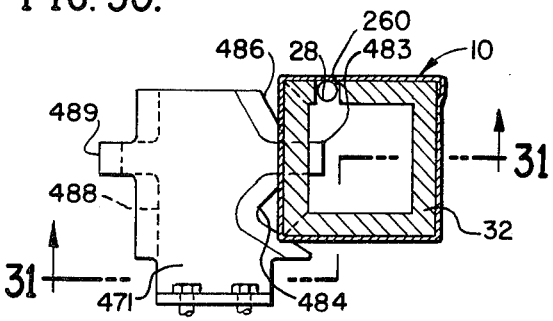
FIG. 38.
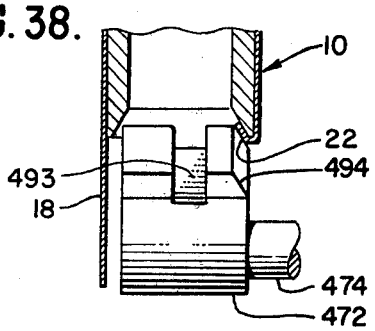
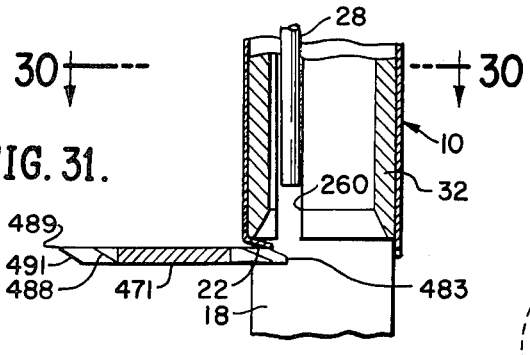
FIG. 31.
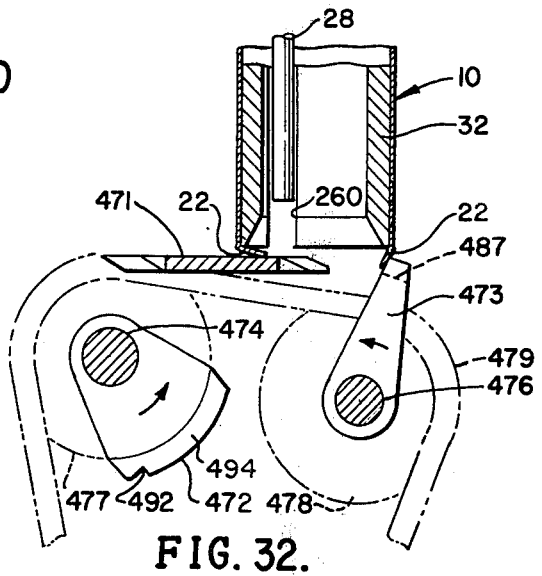
FIG. 32.
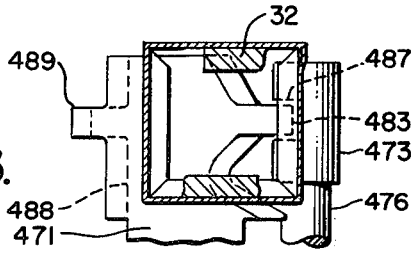
FIG. 33.
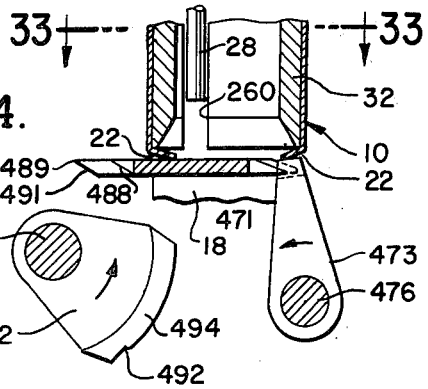
FIG. 34.
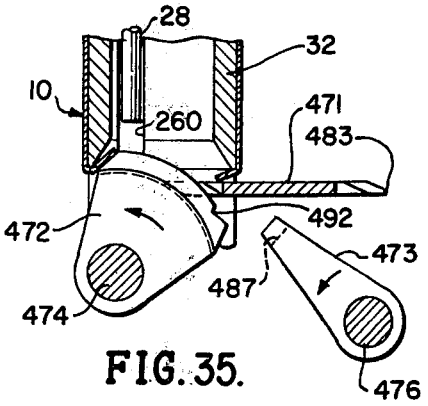
FIG. 35.
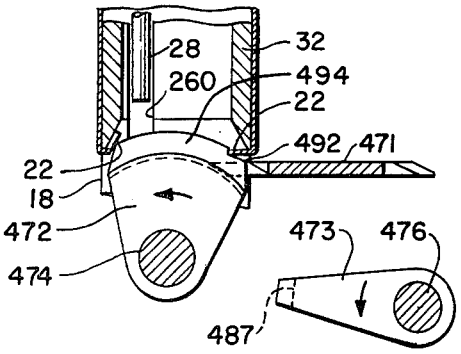
FIG. 36.
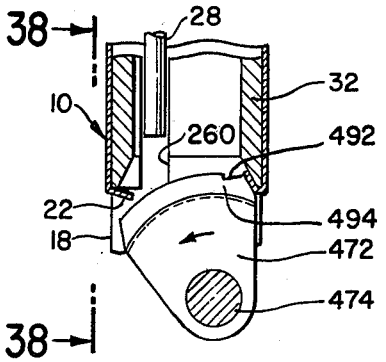
FIG. 37.

CARTON FORMING APPARATUS

BACKGROUND OF THE INVENTION

U.S. Pat. No. 3,800,667 granted Apr. 2, 1974 to Charles W. Jones and Dwight L. Stetler discloses apparatus for forming a carton of the type that the apparatus to be described hereinafter is intended to form. The carton itself is generally of the type shown in U.S. Pat. No. 3,749,300 granted July 31, 1973 to Charles W. Jones, and a somewhat modified blank from which the carton is formed is disclosed in co-pending application Ser. No. 628,444, filed Nov. 3, 1975 by Mitchel J. Matovich, Jr. It is a carton of rectangular cross-section, preferably formed from a T-shaped blank of polyethylene coated paper board. The T-shaped blank provides four side wall panels, an end one of which has integral therewith two end-closure panels which, after the blank has been formed into a tube of rectangular cross-section, are folded down upon and sealed to the open ends of the tube.

As shown in U.S. Pat. No. 3,800,677 the carton blank is provided on one of its sides with an access flap to which is attached on the inside of the carton a straw or sipper, and the liquid content of the carton may be consumed by lifting the access flap thereby exposing an end of the sipper from which the contents of the carton may be drawn into the mouth. In the formation of the carton by the apparatus shown in U.S. Pat. No. 3,800,677 both ends of the carton are closed and sealed prior to the filling of the carton, and in accordance with the disclosure of U.S. Pat. No. 3,775,943 granted Dec. 4, 1973 to Charles W. Jones the carton is filled by lifting the flap and filling through the access aperture, after which the aperture is sealed by the application of a length of tape covering the access flap which has been pressed back down into the access aperture. The apparatus shown in U.S. Pat. No. 3,800,677 closes and seals both ends of the carton simultaneously, and this precludes the utilization of a mandrel against which to close and seal the bottom of the carton.

SUMMARY OF THE INVENTION

In a preferred embodiment of the invention the carton forming equipment has the configuration of a closed circuit conveyor. It comprises upper and lower motor drive sprocket chains. The chains carry vertically mounted posts in pairs supported on the outside of the chains for transporting the carton blanks to the several processing stations. Each of the pairs of the posts supports a vertically disposed plate for receiving and retaining a carton blank. Associated with each plate is a mandrel which is slidably mounted on a carrier on the posts and which is engaged at its upper end with a stationary box-cam track, the function of which is to lower and raise the mandrel into and out of association with the blank at appropriate points in the travel of the blank. As previously stated the carton blanks are T-shaped and preferably consist of three identical side panels each having at both ends a sealing tab, and at one end of the blank a fourth side panel of the same size as the other three and carrying at its ends carton-closure panels and along its free edge a side-seam tab.

The blanks are delivered to the transport plates from a stack and oriented so that the panel which carries the end-closure panels is at the left-hand end, the blank being ninety degrees clockwise out of the normal upright position of a T. The chains are driven continuously by the sprockets so that the blanks are received "on-the-fly" from the stack. The blank is supported with the inner surface facing outwardly. The blank is pre-scored along all sealing tabs, between the side panels of the blank, and between the two end-closure panels and the side panel with which they are associated, the scoring facilitating the bending or flexing of the component portions of the blank into positions for formation of the carton.

When the advancing blank encounters its first operational station a blade-like member comes into engagement with the rear or outer surface of the side seam sealing tab, which extends clear of the transport plate, and at the same time a barrier member comes into engagement with the inner surface of the carton panel, preferably at the side seam tab scoring and the blade flexes the tab outwardly from the plane of the transport plate while the barrier member holds the blank in contact with the plate.

As soon as the blank has been moved clear of the side seam sealing tab flexing apparatus the mandrel is moved downwardly by its controlling cam track so that it covers the upper closure panel and the side wall panel with which the closure panels are associated, and so that its lower end is substantially in registry with the indentation line delineating the lower end-closure panel.

At the next station, with one of the four side panels confined between the mounting plate for the blank and the mandrel the other three side panels are bent around and wrapped around the mandrel, the bending occurring at the indentation lines delineating the several panels which, in the wrapping operation, come into coincidence with the corner edges of the mandrel. In the wrapping operation the end one of the three side panels is not brought into surface contact with a side of the mandrel but is held at an angle relative to that side, the free edge of the side panel confronting and spaced a short distance from the side seam sealing tab, which was previously bent so that it now underlies the edge of the free fourth side panel of the carton blank.

This brings the partially formed carton to an end one of two parallel paths of travel of the conveyor chains at which point the chains have 180 degree engagement with upper and lower sprockets. During the travel of the partially formed carton around the sprockets, the nozzle of a heater unit, on a support driven by the sprockets through a connection affording coaxiality or deviation therefrom, is presented in alignment with the open space between the side seam sealing tab and the edge of the fourth side panel to heat and melt the polyethylene on the outer surface of the sealing tab and the inner surface of the fourth wall panel.

About the time that the partially formed carton moves out of registry with the nozzle of the heater, the fourth wall panel of the blank is clamped into engagement with the side seam sealing tab and is held there until the polyethylene has congealed and a liquid-tight side seam has been formed.

The next station comprises a set of rotatable deflectors for flexing the three sealing tabs at the bottom of the blank, which has now been formed into a tube open at both ends. The indentation lines delineating these sealing tabs are located at the bottom of the mandrel and the rollers bend the flaps toward the open end of the mandrel.

As the blank carrier transports the blank away from the sealing tab flexing deflectors a carton closure plate that is carried by the blank carrier below the inner end of the mandrel rocks the lower closure panel about the indentation line delineating it and upwardly into an angular position relative to the lower end of the mandrel, and confronting the sealing tabs. The carrier next transports the partially formed carton past the nozzle of a heater which melts the polyethylene on the inner surface of the lower closure panel and the lower or outer surfaces of the sealing tabs. After the partially formed carton passes out of registry with the heater nozzle the closure plate that brought the lower closure panel into proximity of the sealing tabs moves upwardly an additional distance to press the lower closure panel firmly into contact with the sealing tabs. The lower end of the carton with the closure plate continuing in the closure panel clamping position, traverses an elongate flat nozzle from which cold air is blown on the bottom of the carton to cool the sealed lower end of the carton and the closure plate. This completes the formation of a carton closed at the lower end and open at the upper end for filling and thereafter the mandrel is retracted from the formed carton and the carton is released from the blank carrier.

DESCRIPTION OF THE DRAWINGS

For a complete understanding of the invention, reference may be had to the following detailed description to be interpreted in the light of the accompanying drawings wherein:

FIG. 1 is a plan view of the carton blank from which the carton forming apparatus of the present invention is arranged to form a carton closed at the bottom and open at the top;

FIGS. 2–5 are schematic perspective views representing the several steps in the formation of a carton;

FIG. 6 is a schematic perspective view of a completed and sealed carton;

FIG. 15 is a top plan view of the crimping station for the side seam sealing tab;

FIG. 16 is a view taken generally on the line 16—16 of FIG. 15;

FIG. 17 is an elevational view of one of the operational components of the side seam sealing tab crimping station mechanism;

FIG. 18 is a diagramatic view showing a complete cycle of the path of operation of the side seam sealing tab crimper;

FIG. 19 is a diagramatic view derived from FIG. 18 and showing in enlargement successive positions of the crimper in a portion of the path as represented in FIG. 18, in relation to the side seam sealing tab of a blank;

FIG. 15 is a top plan view of a rotary platform supporting heaters for conditioning the blank for closure and sealing of the side seam;

FIGS. 30 and 33 are schematic plan views and FIGS. 31, 32, and 34 to 37 are schematic elevational views, all partly in section showing progressively in stop-action manner the operation of the components of the station at which the sealing tabs for the bottom closure panel are flexed;

FIG. 38 is an elevational view partly in section taken generally on the line 38—38 of FIG. 37;

DETAILED DESCRIPTION

Figure 7:
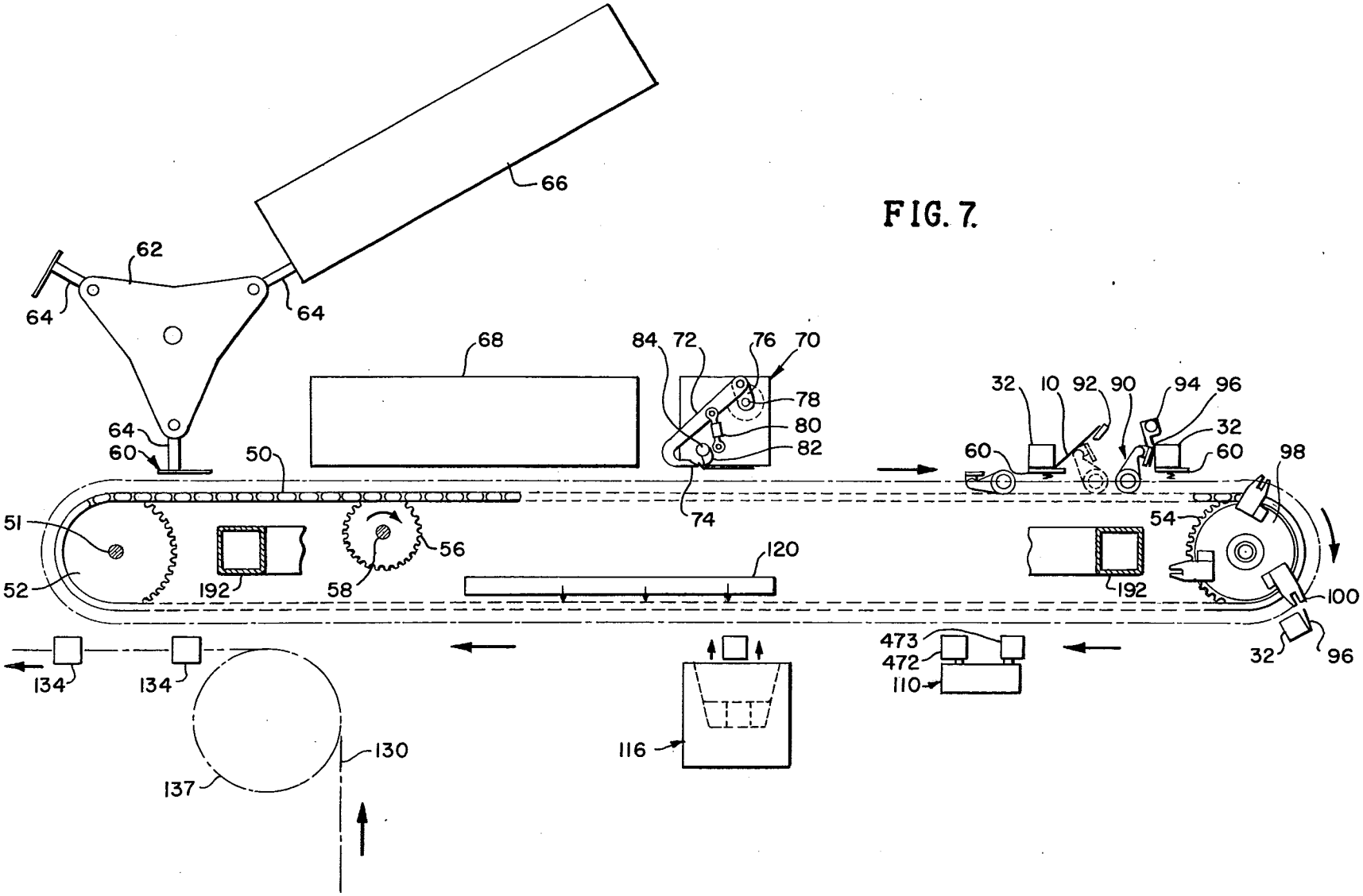
FIG. 7 is a schematic plan view of the entire carton forming apparatus with the relative locations of the principal carton forming components shown.

Before beginning the detailed description of the apparatus for forming the carton blank into an open ended carton the several steps involved in forming the carton will be described in terms of the blank itself, reference being had to FIGS. 1 to 6.

Referring now particularly to FIG. 1 the reference numeral 10 designates a blank of T-shaped configuration, from which a complete carton, sealed to be liquid-tight, may be derived without requiring any other carton body components. The blank is comprised of four carton side wall panel elements 11, 12, 13 and 14, separated or delineated by indentation lines or scorings 16, along which the folding of the blank into carton configuration takes place. The wall panel element 11 has integral therewith, and delineated by indentation lines or scorings 17, the carton end closure panel elements 18 which, in the particular instances, are square because the four side wall panel elements 11, 12, 13 and 14 are shown as being of equal width. The side wall panel elements 12, 13 and 14 have at their ends sealing flap or tab elements 22 delineated by scoring lines 23. Along its free edge the side wall panel element 11 is provided with a sealing tab element 24 delineated by the indentation or scoring line 26. Finally, in the case of a carton particularly adapted to hold potable liquids and provided internally with a sipper as taught by Kalajian, U.S. Pat. No. 3,259,297 granted July 5, 1966, one of the side wall panel elements, for example the side wall panel element 11, may be provided with a closure flap adjacent to one end of the panel and extending parallel to the long dimension of the side wall panel element 11. The flap is produced by cutting through or so nearly through the side wall panel element 11 as to enable the flap to be lifted readily up out of the plane of the wall panel 11 to reveal an access orifice, and is produced by making two longitudinal cuts with one transverse cut so that the flap remains integrally attached to the wall panel element 11. If the carton is provided with an access flap 27 it is convenient to secure a sipper to the inner surface of the closure flap 27 before the formation of the blank into a carton is started and the sipper is designated by the reference numeral 28 in FIGS. 2 to 5.

The first step in the formation of the carbon from a flat blank is the bending of the side seam sealing tab element 24 about its delineating indentation line 26 in the direction indicated by the arrow 30 in FIG. 2. In the mechanism to be described hereinafter the bending of the sealing tab element 24 takes place before the mandrel around which the carton is to be formed has descended into carton forming position and the mandrel has been shown only in FIG. 2 on the sheet containing FIGS. 1 to 6, and in phantom outline in that figure of the drawings, to indicate the position it occupies during the formation of the carton. The mandrel is designated by reference numeral 32.

Following the bending of the sealing tab 24 the carton blank is wrapped around the mandrel in the direction indicated by the arrow 34 in FIG. 3, and into the position indicated in that figure, with the inside of the wall panel 12 in contact with the left-hand side of the mandrel, the wall panel 13 in contact with the front of the mandrel and the wall panel 14 at an angle relative to the right-hand face of the mandrel, with the free edge of the wall panel 14 confronting the sealing tab 24.

FIG. 4 represents the completion of three additional steps as compared with the condition indicated in FIG. 3, two of these being the heating, by heat from a burner, of the outer surface of the sealing tab 24 and the inner surface of the wall panel 14, and the pressing of the inner surface of the wall panel 14 against the sealing tab 24 to complete a liquid-tight seam, the carton having now been formed into an open ended tube. Further steps represented in FIG. 4 as having been accomplished are the bending of the sealing tabs 22 at the lower end of the carton upwardly toward the open end preparatory to closure of the lower end of the carton and the flexing of the lower carton closure panel 18 to bring it into position to have its inner surface heated along with the lower surfaces of the lower sealing tabs 22, by a blast of heat. Following the heating of the lower closure panel 18 and the lower sealing tabs 22 the lower closure panel 18 is moved an additional distance in the direction indicated by the arrow 36 to bring it into a clamped position in contact with the lower sealing tabs 22 so that a liquid-tight seal at the bottom of the carton will have been formed when the melted polyethylene on the surfaces congeals. It should be noted that the ends of the sealing tabs 22 are cut away at an angle of about 45°, so that when the tabs are bent inwardly 90° relative to the carton wall panels incident to the closing of an end of the carton the ends of adjacent sealing tabs 22 will confront one another.

FIG. 5 shows the carton, in the form as completed by the apparatus to be described hereinafter, the carton being open-ended at the top. FIG. 5 also contains a schematic representation of a nozzle 38 from which the carton is being filled. Apparatus for filling open ended cartons is well known and forms no part of the present invention. FIG. 6 indicates, by means of the arrow 40 the direction in which the upper closure panel 27 is moved to close the carton. Apparatus for closing and sealing an open ended carton that has been filled with a liquid and that is provided with a top closure panel that is integral with the carton and that is to be depressed into engagement with and sealed against sealing tabs at the upper ends of the side wall panels of the carton is disclosed in cop-pending application Ser. No. 628,443, filed Nov. 3, 1975 by E. Alan Williams.

SUMMARY OF CARTON FORMING MACHINE COMPONENTS

Figure 8:
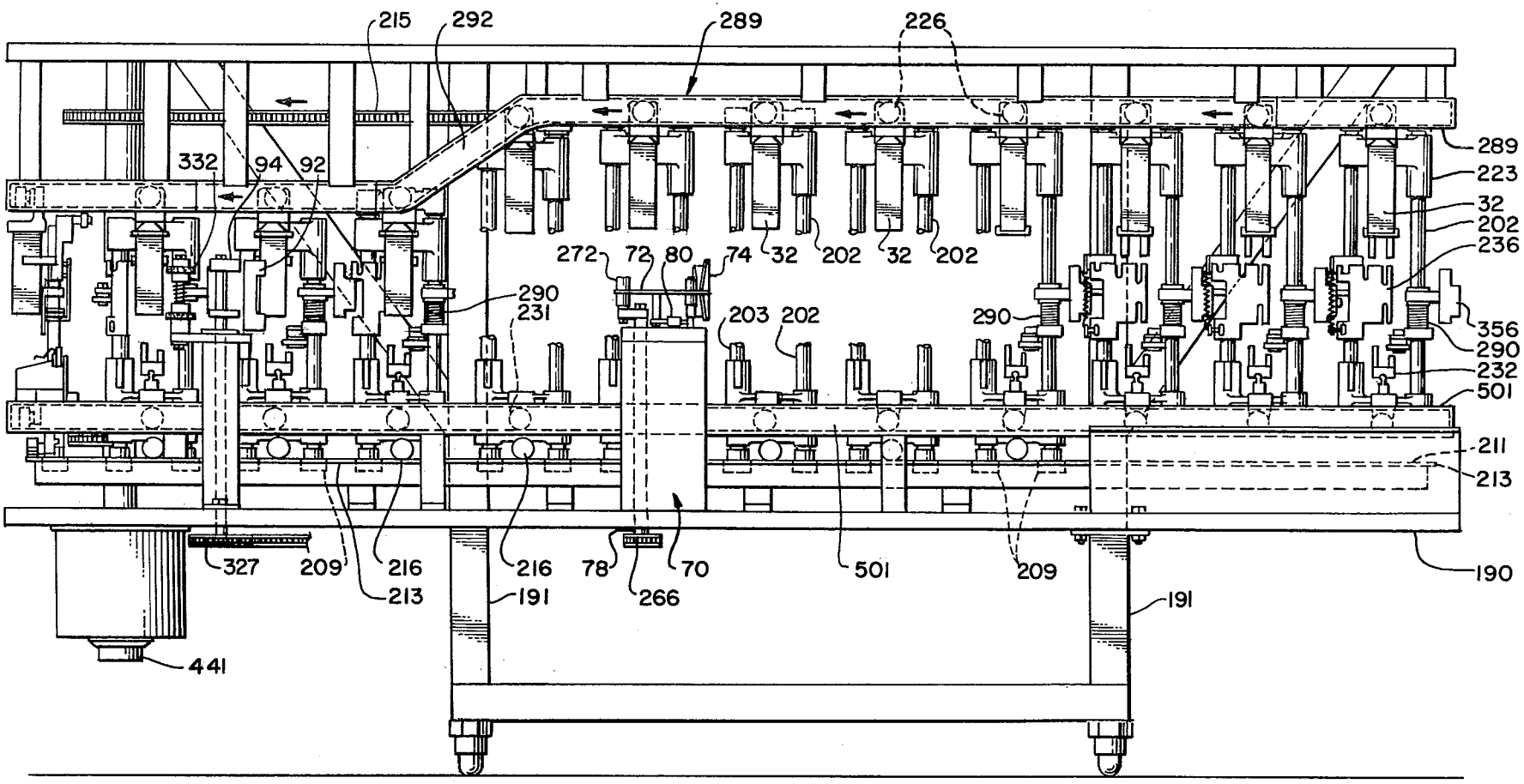
FIG. 8 is a schematic elevational view of what will be considered as the front of the carton forming apparatus and corresponds to a view looking downwardly from the top of the sheet containing FIG. 7 of the drawings.

FIG. 7 is a schematic representation of the components of the apparatus for forming the carton. In FIG. 7 a conveyor chain 50 is supported by sprockets 52 and 54 for movement in the direction indicated by the arrow. The sprocket 52 is mounted on a shaft 51 (FIGS. 7 and 8). The shaft 51 is driven from a motor and suitable reduction gearing (not shown). The sprocket 52 is secured to the shaft 51 in a conventional manner, such as by keying, and the shaft supplies the driving power through the sprocket 52 and chain 50 for all driven components of the carton forming mechanism. A sprocket 56 mounted on and connected to a shaft 58 engages the chain 50 internally and represents a power take-off for driving various carton forming components in timed relation to advancement of the carton blank carriers.

Carriers for the carton blanks are designated by the reference numeral 60 and these are mounted to be transported by the chain 50 and are uniformly spaced throughout the length of the chain. A rotatable device 62 which has been called a singulator is provided with a plurality of arms 64 that remove the blanks 10 from a magazine 66, one by one and transfer them to the carriers 60 on the chain 50. The speed of rotation of the singulator 62 in relation to the velocity of the chain 50 is such that each of the blank carriers 60 receives a blank 10 from the singulator 62, and the singulator may be driven through appropriate intermediate gearing from the shaft 58. The singulator 62 forms no part of the present invention and a device of this type for performing a similar function is shown in U.S. Pat. No. 3,060,654 granted Oct. 30, 1962 to A. R. Lubersky et al.

Following the depositing of a blank 10 on a blank carrier 60 by the singulator 62 the carrier comes into cooperative association with a station for applying a sipper to the inner surface of the blank in the position shown in FIGS. 2 to 6, this station being shown in dotted outline and designated by the reference numeral 68. It forms no part of the present invention.

The blank 10 next comes into cooperation with a station designated generally by the reference numeral 70, that performs the operation of flexing the sealing tab 24. This station has an arm 72 that is provided at one end with a blade 74 which is the instrumentality that engages and flexes the sealing tab 24 on the blank 10. At its other end the arm 72 is pivotally connected to crank arm 76 that is secured to a rotatable shaft 78. Intermediate its ends the arm 72 is pivotally connected to a link 80 that is pivotally supported at its other end on the top of the sealing tab flexing unit 70. The motion that is imparted to the blade 74 by the lever 72 under the constraint of the link 80 is such that the blade swings in behind the sealing tab on the edge of a blank which is being moved in the direction indicated by the arrow and then the blade is pulled forward against the outer surface of the sealing tab 24 to flex it in a direction away from the surface of the blank carrier 60 as viewed in FIG. 7. At the time that the bending of the sealing tab occurs a restraint member 82 that is mounted on a shaft 84 which rotates in the direction indicated by the arrow has passed across the sealing tab 24 on the advancing blank 10 and is blocking the blank 10 at or closely adjacent to the indentation line 26 against movement away from the carrier 60 and the restraint member 82 may serve as a fulcrum against which the flexing of the sealing tab 24 takes place.

As will be more fully described hereinafter each of the carton blank carriers is provided with a vertically moveable mandrel 32 which is suspended above the space occupied by a carton blank 10 on the carrier 60 prior to arrival of the carrier 60 into cooperation with the singulator 62 and remains thus suspended until after the flexing of the sealing tab 24 by the assembly 70. Following the flexing of the sealing tab the mandrel 32 is lowered into the relationship to the blank indicated in FIG. 2.

Each of the carton blank carriers 60 is provided with a cam operated pivotally mounted rocker member, designated generally by the reference numeral 90, for serving the purposes of initiating the folding or wrapping of a carton blank 10 around the mandrel 32, for retaining it in the wrapped position during the heating of the surfaces that are to be sealed together to form a side seam, and forming the seam. In FIG. 7 near the right-hand end of the upper run of the chain 50 two carton carriers 60 with their associated mandrels 32 and their rocker members 90 are shown schematically. A third rocker member 90 is shown in dotted outline and this is the same member as the one shown with the right hand of the two carton carriers 60 but in an instantaneous position part way through its clockwise rotation from the unoperated position, when associated with the left-hand carton carrier 60, to completion of its first operative step. The geometry of the structure is such, having reference to the distance between centers of successive carriers 60, the pivotal location of the rocker member 90 on the carrier, and its swing, that as the carton carriers are approaching the position at which the carton blanks become wrapped around the mandrels and the rocker members 90 are in their unoperated positions the free end of each is behind the blank 10 carried by the immediately following carrier 60. When the rocker 90 begins to rotate in clockwise direction as viewed in FIG. 7 it engages the surface of the blank carried by the following carrier and bends the blank in its first increment of wrapping about the mandrel 32 as indicated by the single representation of a blank 10 in FIG. 7. As the blank shown that is seen in FIG. 7 advances rightwardly it encounters a barrier 92 and the blank in passing between this barrier and the face of the mandrel 32 undergoes its second incremental bend, bringing the side wall panel 13 (FIG. 1) into contact or substantial contact with the front of the mandrel 32. While the side wall panel 13 of the blank is being held substantially in contact with the front of the mandrel a rotary assembly 94 engages the side wall panel 14 and flexes it inwardly along the side of the mandrel 32 sufficiently for the arm 90 to come into engagement with that panel, and by means of a pressure plate 96 pivotally attached to the rocker member 90 to press the side wall panel 14 into a position of confrontation of its free edge with the outer surface of the sealing tab 24, corresponding generally to the showing in FIG. 3.

The right-hand sprocket 54 has parallel mounted above it and connected to it, by a connection affording coaxiality or deviation therefrom, a platform or turntable 98 which supports a plurality of heaters 100. As the carton blank carrier 60 brings the wrapped and clamped blank to the beginning of travel around the sprocket 54 the nozzle of one of the heaters 100 comes into registry with the aperture between the edge of the panel 14 of the clamped blank and the side seam tab 24, the width of this aperture being determined by the pressure plate 96 on the rocker 90. The spacing of the heater nozzles 100 angularly upon the turntable 98 is the same as the distance between centers of the carton blank carriers 60 as they travel around a semi-circular arc, so that each carton carrier will come into registry with and travel around with one of the heaters 100. About the time that the carton carrier 60 begins to move out of registry with the heater 100 as the carton carrier 60 begins its travel along the lower arm of the chain 50 the cam operated rocker 90 is moved an additional distance in clockwise direction to cause pressure plate 96 to further flex the panel 14 of the blank and press it into an engagement with the side seam tab 24. During the time that the blank was traveling with the heater 100 heated air at a sufficient temperature to melt the polyethylene coating on the inner surface of the panel 14 of the blank and the outer surface of the side seam tab 24 melts that coating and when the two have been pressed together following the heating the polyethylene congeals and forms a liquid tight seal along the entire length of the side seam tab 24.

With the side seam remaining clamped the carton blank carrier next passes across a sealing tab crimping station 110 which is provided with a set of rotating tab crimpers, designated by the reference numerals 472 and 473, the function of which is to flex the three sealing tabs 22 at the bottom of the carton tube inwardly preparatory to closure of the bottom of the carton. After the carton blank carrier 60 leaves the crimper station 110 a carton closure plate which is carried by the carton blank carrier is moved upwardly to engage the lower carton closure panel 18 and flex it into confronting but spaced relation to the flexed sealing tabs 22 at the bottom of the carton tube. The carton blank carrier next transports the formed open-ended tube past a heater unit 116 which is provided with a nozzle that directs a blast of heated air against the lower or outer surfaces of the lower sealing tabs 22 and the inner or upper surface of the lower carton closure panel 18 to melt the polyethylene coating on those components of the carton blank. After the polyethylene has been melted the carton closure plate carried by the carton blank carrier 60 is moved through the second step of the operation to clamp the lower closure panel 18 of the carton blank into engagement with the lower sealing tabs 22, and effect the liquid tight sealing of the bottom of the carton. The carton carrier 60 next passes along a cooling vent 120 from which a blast of cold air is blown against the lower end of the carton and the lower carton closure plate to cool the lower end of the carton and the closure plate preparatory to retraction of the plate from clamping relation to the lower end of the carton.

This completes the forming of the carton and as the carton carrier continues its movement with the conveyor chain 50 the lower carton closure plate is retracted to its idle or unoperated position, the mandrel 32 is lifted and the carton is stripped from the mandrel and released from the carton blank carrier 60. As indicated in FIG. 7 a transport conveyor may be juxtaposed to the point of release of the carton from the conveyor for transfer to a place of storage or accumulation, or directly to a filler. The juxtaposed conveyor is shown schematically in FIG. 7 and is designated by the reference numeral 130. It is shown as passing around a sprocket 137 to bring it into position to receive the formed cartons. The reference numeral 134 designates formed cartons carried by the conveyor 130.

SUPPORT STRUCTURE

Figure 9:
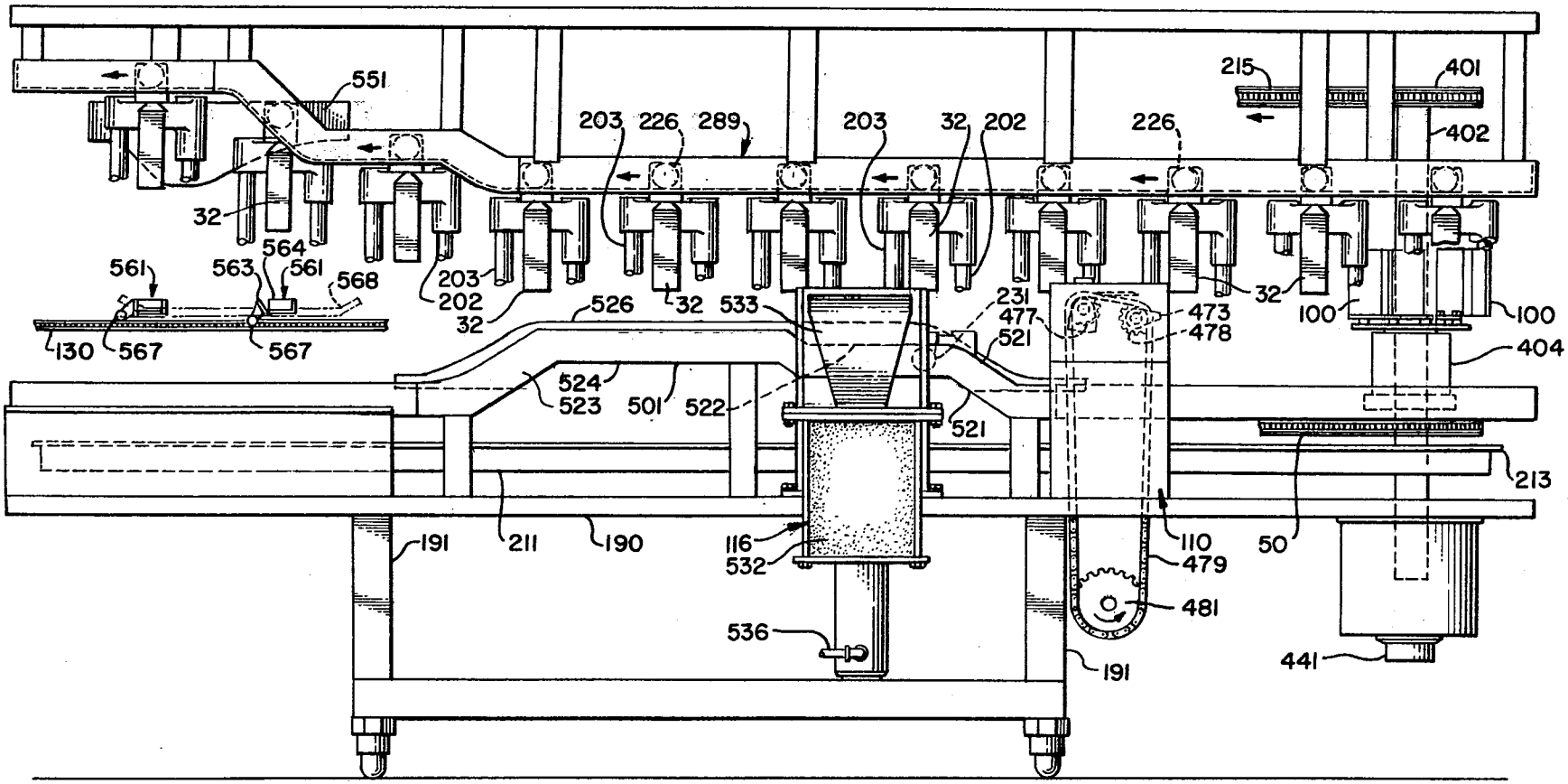
FIG. 9 is a schematic elevational view of what will be considered as the back of the carton forming apparatus and corresponds to a view looking upwardly from the lower edge of the sheet containing FIG. 7.

The operative mechanism of the carton forming apparatus is mounted on a table comprised of a platform 190 supported by legs 191 (FIGS. 8 and 9). Near its ends the platform supports posts 192 (FIGS. 7, 10A and 10B) to which various components, to be identified hereinafter, are secured. Other components that are supported directly or indirectly by the platform 190 will be identified as they are introduced in the following description.

CARTON BLANK CARRIER

Figures 12, 13:
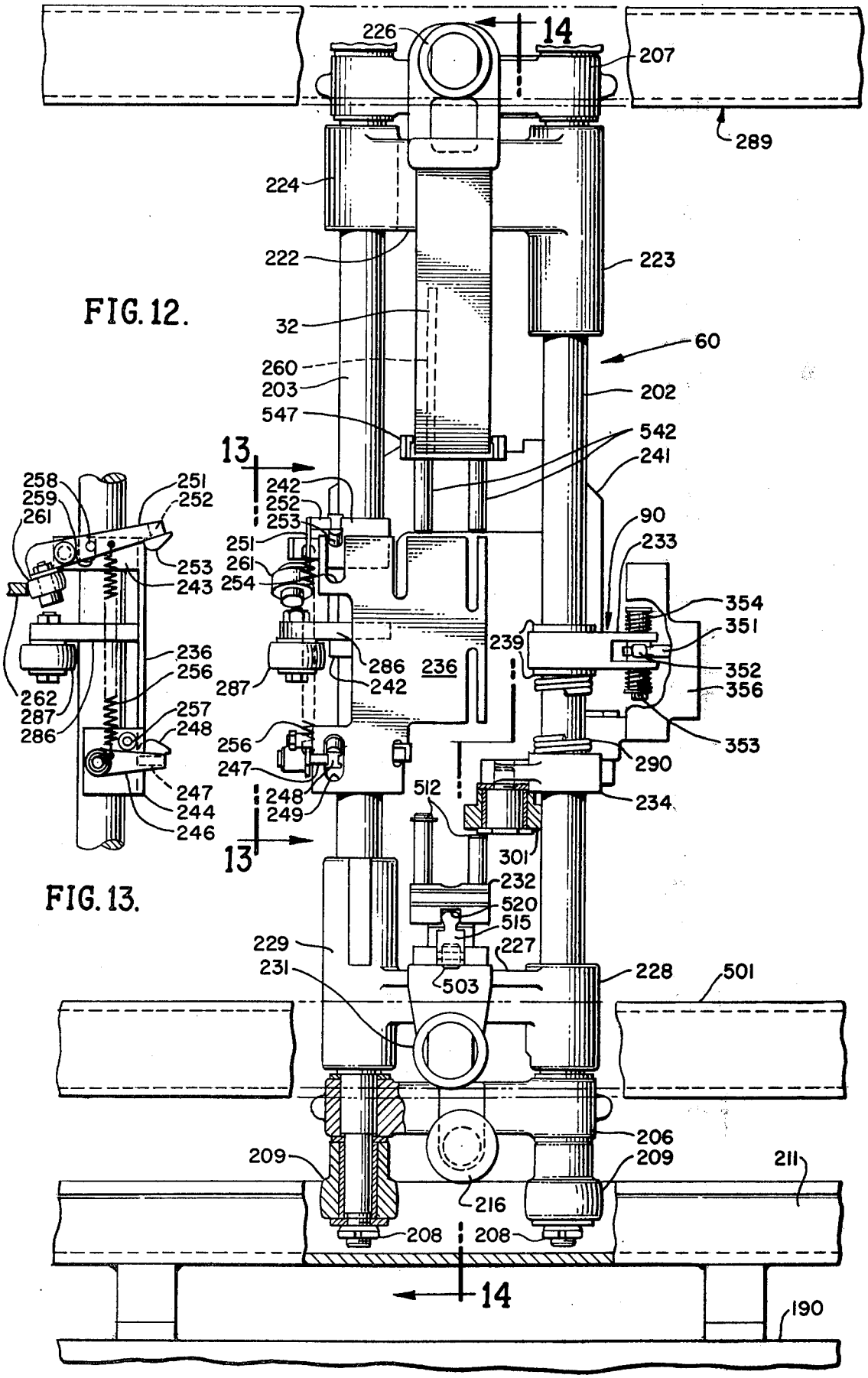
FIG. 12 is a front elevational view showing one of the carton blank carriers.
FIG. 13 is a detailed elevational view taken on the line 13—13 of FIG. 12.
Figure 14:
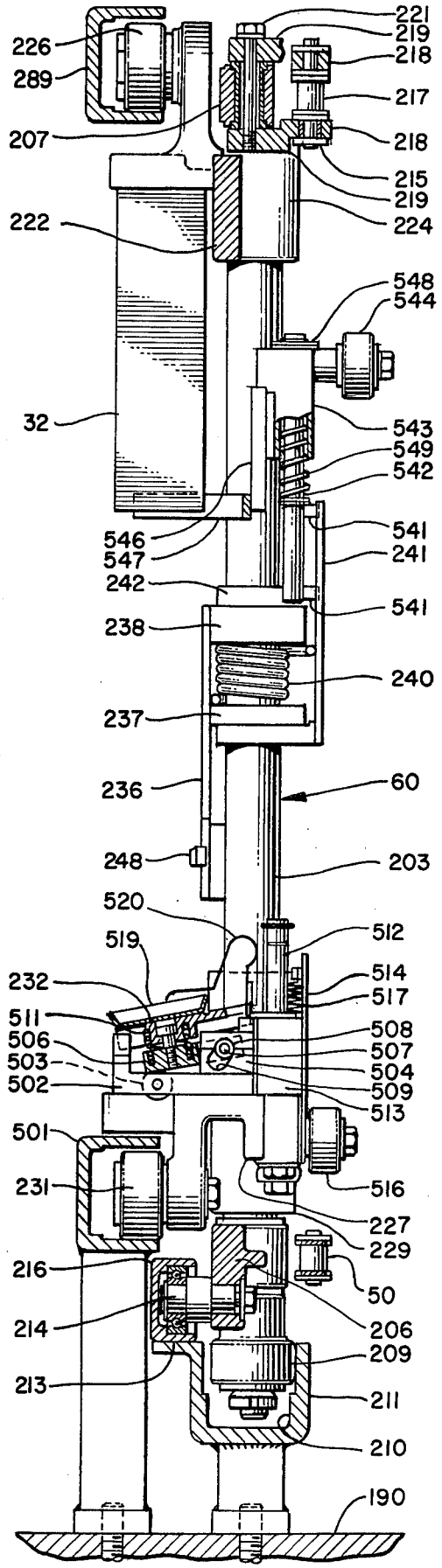
FIG. 14 is a side elevational view taken generally on the line 14—14 of FIG. 13.

The carton carrier assembly is shown in FIG. 12 in front elevation and in FIG. 14 in right side elevation and is designated generally by the reference numeral 60, corresponding to the reference numeral in FIG. 7. All of the components in the carton carrier 60 are carried by a frame which is comprised of right-hand and left-hand rods 202 and 203, respectively, as viewed in FIG. 12, and lower and upper rod supports 206 and 207, respectively. The ends of the rod supports 206 and 207 are formed as sleeves to receive the rods 202 and 203. The support 206 rests against shoulders formed on the rods 202 and 203 and the rods receive rollers 209 and lock nuts 208 at their lower ends which retain the rollers and seat the support against the shoulders. The rollers 209 ride in a track groove 210 in a channel member 211 mounted on the platform 190. The upper ends of the rods 202 and 203 are provided with similar lock nuts, and rollers riding in a guide channel (not shown). The lower support 206 carries midway between the rods 202 and 203, a pin 214 which extends outwardly or forwardly from the support 206 and the pin 214 rotatively supports the roller 216. The roller 216, traveling on a flange 213 associated with the channel 211, supports the carton carrier 60 and the rollers 209, confined in the channel member 211, guide the carton carrier 60 in its travel around the closed circuit path shown in FIG. 7.

Figure 10A:
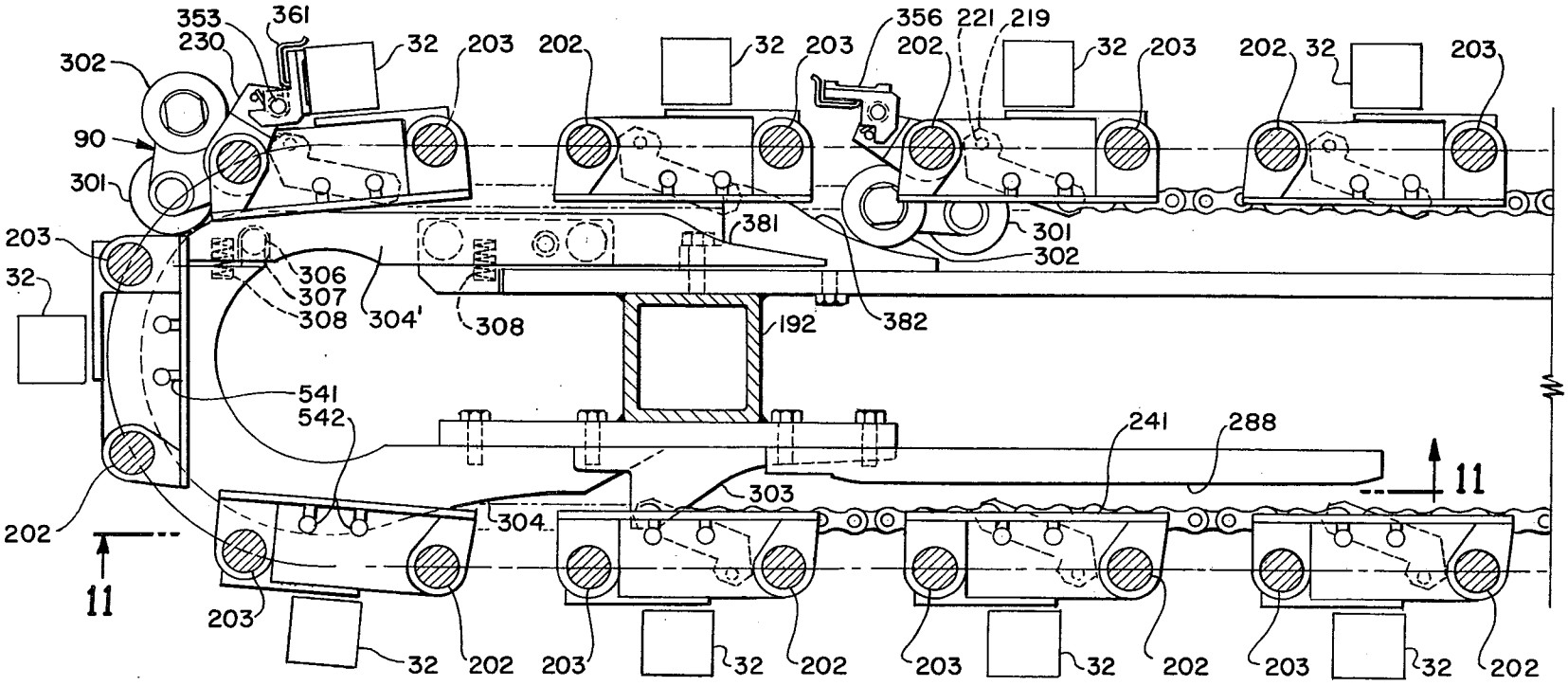
FIGS. 10A and 10B, when placed end to end with FIG. 10A at the left of FIG. 10B, comprise a schematic plan view corresponding to the schematic view in FIG. 7 but showing primarily the carton carriers, the driving mechanism for them, and certain cam surfaces by which their operation is controlled.
Figure 10B:
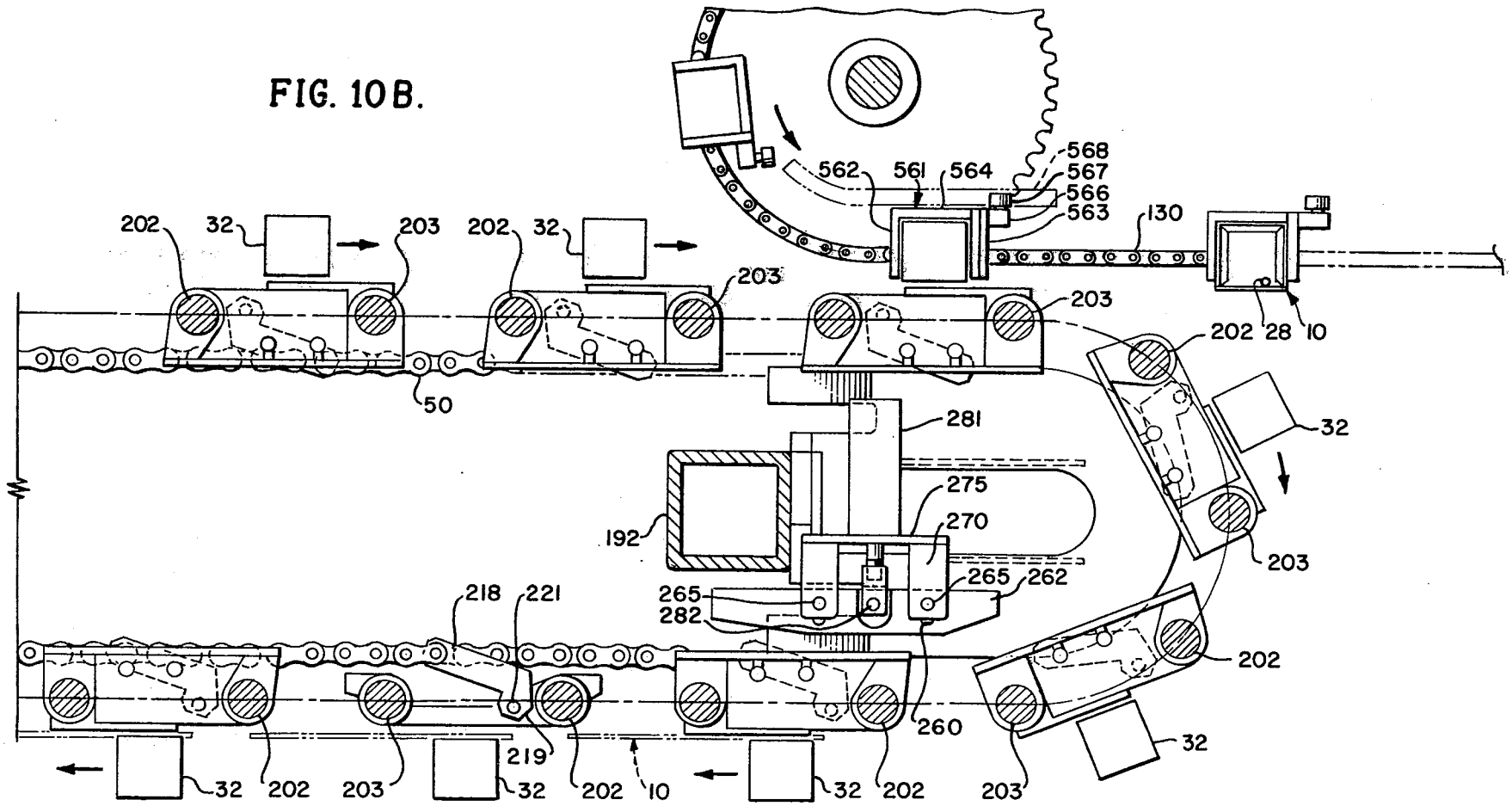

Behind the carton carrier 60 and specifically opposite the lower support 206 is the driving chain 50 that was identified in FIG. 7. Above and in line with the chain 50 ans specifically opposite the upper carton carrier support member 207 is a companion chain 215 (FIGS. 10A, 10B and 13). At intervals along the chain 215 its link pins 217 are provided with drag links 218 having their outer ends 219 spaced apart a distance which permits them to receive between them the upper support member 207. A bolt 221 extending through the outer ends 219 of the upper and lower drag links 218 and through the upper support member 207 connects the chain 215 to the carton carrier 60. In a similar manner the chain 50 may be connected to the lower support member 206. This detail has not been shown in FIGS. 10A, 10B or 14.

At their upper ends, below the carton carrier support member 207 the rods 202 and 203 slidably support a slide member 222 the ends of which are in the form of sleeves 223 and 224 which slide on the rods 202 and 203. The slide member 222 supports the mandrel 32 and above it a cam follower roller 226.

Another slide member 227, the ends of which are in the form of sleeves 228 and 229, is slidably mounted on the rods 202 and 203 above the lower support member 206. The slide member 227 is provided with a cam follower roller 231 and the slide supports, facing upwardly toward the lower end of the mandrel 32, the closure plate 232 for closing and sealing the bottom of the carton.

CARTON BLANK HOLDING PLATE

The left hand rod 203 supports for pivotal but not slidable movement the carton plate holding blank 236. The plate 236 is attached to hubs 237 and 238 (FIG. 14) by which the plate is pivotally mounted on the rod 203. On the right hand rod 202 the rocker heretofore identified by the numeral 90, now to be identified generally by the reference numeral 90, and now designated more fully as a carton forming rocker assembly, is pivotally but not slidably mounted. Rocker assembly 90 actually comprises upper and lower arms 233 and 234 joined together by a vertical connection (not shown) so that they are pivotally moveable on the rod 202 as a unit. The hub portion of the upper arm 233 is confined between brackets 239 that are fitted over the rod 202. The brackets 239 extend rearwardly of the carton carrier and support one end of a mounting plate 241 for apparatus that will be described hereinafter. The remainder of the support for the plate 241 comprises brackets 242 that are above and below the mounting hubs 237 and 238 for the carton blank supporting plate 236 and that extend rearwardly of the carton carrier.

At its left hand edge the carton blank mounting plate 236 is provided with rearwardly extending upper and lower projections 243 and 244 respectively (FIG. 13). The lower projection 244 pivotally mounts lever 246 which at its free end has a laterally extending arm 247 on the end of which is mounted a carton blank retaining block 248. In alignment with the block 248 the plate 236 is provided with a vertically directed slot 249 and the block 248 extends into the slot. The upper projection 243 also pivotally supports a lever 251 which has at the end of its forwardly extending arm a laterally extending arm 252 on the end of which is mounted a carton blank retaining block 253, which is a companion to and in vertical alignment with the block 248. The plate 236 is provided with a vertically directed slot 254 and the block 253 extends into the slot 254. The levers 246 and 251 are attrahently biased by a spring 256. A stop pin 257 carried by the projection 243 of the plate 236 limits counterclockwise movement of the lever 246, and a stop pin 258 carried by the lever 251 cooperates with the lower end of a slot 259 in the upper projection 243 of the plate 236 to establish a limit to the clockwise movement of the lever 251. The rearwardly extending arm of the lever 251 is provided with a roller 261 that is cooperable with a shiftable cam rail 262. The location of the cam rail 262 in the apparatus and manner of shifting it will be described hereinafter. When the cam rail 262 is retracted so as not to be engaged by the roller 261 the spring 256 will position the levers 246 and 251 at minimum distance between the blank retaining blocks 248 and 253 as determined by the stop pins 257 and 258. It will be understood that the stop pins 257 and 258 may be adjustable in any convenient manner, such as by the provision of eccentric sleeves on the ends to establish the position of the lower retainer block 248 as a limitation of the height relative to the plate 236, and to establish the minimum distance between the upper and lower blocks 253 and 248.

It will be noted particularly in FIG. 12 that the confronting surfaces of the blank retainer blocks 248 and 253 are convex and the curvature is symmetrical about a vertical plane bisecting the blocks. It will be noted in FIG. 14 that from front to back the block 248 slopes upwardly and then reverses in a curve and slopes downwardly, and that the contour of the block 253 is an inversion or mirror image of the block 248. As previously stated, the sealing tabs 22 at the ends of the carton side wall panels 12, 13, and 14 are notched at an angle of approximately 45° so that the confronting ends of adjacent sealing tabs form an angle of 90 degrees, with the apex at the end of a scoring line 16. The conformation of the retaining blocks just described enables them to cooperate with a pair of opposite notches in the blank for the purpose of receiving and retaining the blank on the plate 236. A blank of the type shown in FIG. 1 is transferred to the carton carrier 60 by thrusting it against the plate 236 with the scoring line delineating the carton panels 12 and 13 generally aligned with the two retainer blocks 248 and 253. This represents two notches in the blank at opposite ends of that scoring line into contact with the surfaces of the blocks 248 and 253 and as the blank is thrust against the plate and notches cam the blocks 248 and 253 apart, the spring 256 yielding to accommodate the separation, until the blank passes across the tops of the front slopes of the two blocks, after which the spring 256 draws the retainer blocks 248 and 253 toward each other, the receding slopes at the inner ends of the two blocks drawing the blank in against the plate 236. With the blank thus positioned on the carrier, the side wall panel elements 13 and 14 of the blank 10 are to the left of the retainer blocks 248 and 253, and the side wall panel elements 12 and 11 are to the right of the retainer blocks, the side wall panel element 11 with its closure panel element 18 being below and in alignment with the mandrel 32 on the blank carrier 60. The right hand edge of the plate 236 coincides generally with the scoring line 26 that delineates the side seam ceiling tab element 24, which leaves this tab extending to the right of the right hand edge of the plate 236.

In an exemplary embodiment of the invention the apparatus is arranged to handle carton blanks of a size suitable for dispensing beverages in such places as schools and places of amusement, particularly places where sporting events are held. Cartons which are frequently used for this purpose have a volumetric capacity of one-half pint. A carton which has a cross-sectional area of four square inches and a height of four inches will conveniently accommodate a half pint, which has a volume of approximately 14.5 cubic inches. By increasing the heighth of such a carbon one inch, the volumetric capacity is increased to 20 cubic inches and this will accommodate one-third quart of liquid, which has a volume of 19.25 cubic inches. The blank shown in FIG. 1 represents a half-pint carton which has a square cross-section of two inches and a height of 4 inches.

Attention is now focused on the control of the upper lever 251 by the shiftable cam bar 262 cooperating with the cam follower roller 261. With the cam bar 262 out of position to be engaged by the follower roller 261 and the spring 256 drawing the levers 246 and 251 to their minimum distance apart, it would be assumed that such minimum distance is about four inches and that the blank that will thus be accommodated will form a carton having a volumetric capacity of one-half pint. With the cam bar 262 engaging the follower roller 261 and lifting the right hand arm of the lever 251, the upper blank retainer bar 253 will be assumed to have been lifted a distance of approximately one inch which will enable the blocks 248 and 253 to capture a blank from which a carton having a volumetric capacity of one-third quart will be formed. In either case the lower edge of the blank will be in the same position, presenting the lower carton closure panel 18 in the same position and it will be noted that the lower right hand corner of the plate 236 is cut away to permit exposure of the lower carton closure panel 18 below the plate 236. With the wider blank, which forms a taller carton, mounted on the plate 236 the upper carton closure panel will be higher by about one inch than with a narrower blank, but the geometry of the mandrel 32, having reference particularly to its length and the amount of travel to lower it into operative position, is such that the mandrel will descend in front of either type of carton blank without interference.

In the description of FIG. 7 the singulator 62 was identified as a device for transferring objects such as blanks from a storage hopper to the carrier. Reference was made to the Lubersky et al patent. The singulator in that patent is arranged to transport flattened cartons in the form of open-ended tubes and in the process of transferring them to a carrier on a conveyor they are opened. The Lubersky device uses suction to attract the cartons to the singulator and the suction is cut off to permit the conveyor to receive the opened cartons. The singulator 62 in FIG. 7 may employ suction to attract blanks from the magazine 66 and hold them until they reach the position for transfer to the carrier 60 at which time the suction may be replaced by a blast of air blown against the blank by the singulator to thrust the blank into position on the plate 236, the blank being grasped and held by the retainer blocks 248 and 253.

The cam bar 262 is shown in FIG. 10B and its location identifies the point at which the singulator 62 thrusts a carton blank 10 against the blank holding plates 236 as the carriers 60 advance in the direction indicated by the arrows. The cam bar 262 is guided for edgewise movement by its slots 260 through which pass pins 265 on arms 270 of a bracket 275 which may be mounted on the post 192. Representing a means for shifting the bar 262 inwardly and outwardly is an air cylinder 281 the piston rod of which is provided with a clevis 282 that engages the cam bar 262. With the cam bar 262 retracted the rollers 261 on the blank carriers 60 will not engage the cam bar 262 and the retainer blocks 248 and 253 will be at their minimum distance apart, to receive a narrow blank. With the cam bar 262 thrust to its outer position the rollers 261 will ride on the outer edge of the cam bar and lift the upper retainer block a distance approximating the difference in width of the narrower and wider blanks. It will be understood that in either case the distance between the blocks 248 and 253 is such that the blocks are cammed apart by the blanks, the spring 256 permitting this, and in turn the spring, working through the blanks, effects the capture of the blanks.

SIDE SEAM SEALING TAB FLEXING

As previously described with reference to FIG. 7, and referring now to FIGS. 15 to 19 for additional description, the first operation on the blank, which may be considered as a forming operation, and which follows the attachment of the sipper 28 to the interior of the carton blank, is the flexing or crimping of the side seam sealing tab 24. This is accomplished at the station designated generally by the reference numeral 70. It derives its driving power from a sprocket 266 (FIG. 8) which is driven by intermediate gearing (not shown) from the sprocket 56 (FIG. 7) to make one revolution for a distance of travel of the chain equal to the distance between centers of the carton carriers 60. The sprocket 265 is attached to the lower end of the shaft 78 which has secured to its upper end the crank arm 76 and it also has secured to it a gear 267 which is in a housing below the top of the tab crimping unit 70. The gear 267 drives a gear 271 through the idler gears 268 and 269. The gear ratio from gear 267 to the gear 271 through the idlers 268 and 269 is unity with a reversal of direction because of the two intervening idlers, and the gears 267 and 271 rotate in the direction indicated by the arrows.

As previously stated a tab crimping arm 72 has one end pivotally connected to the crank arm 76, the connection comprising, as shown in FIG. 16, a hub 272 fitted over a pin 273 carried by the crank arm 76. At its other end it carries the elongate blade-like member 74. At a predetermined distance from the connection to the crank arm 76 the crimping arm 72 has a depending prong 274 which is pivotally connected to one end of a link 80. The other end of the link 80 is pivotally associated with a bolt 277 which is threaded into the top of the gear housing. It will be apparent from this that as the crank pin 273 moves the hub 272 of the lever 72 in a circle, in clockwise direction as viewed in FIG. 15, the depending prong on the lever 72 will be swung back and forth in an arc which has its center on the pivotal mounting for the link 80, which is the bolt 277.

The shaft 84 which is driven by the gear 271 rises above the gear housing and has secured thereto a hub 278. The hub 278 pivotally supports the previously identified restraint member 82, the function of which is to preclude disengagement of the blank from surface engagement with the carrier plate 236 as the crimping blade 74 on the lever 72 flexes the side seam sealing tab 24. Torsion springs 279 bias the restraining member 82 in counter-clockwise direction against a limit stop (not shown) and the spring yields when the restraining member 82 is caused to rotate in clockwise direction on its pivotal support under circumstances that now will be described.

With the shaft 78 (FIGS. 15 and 16) in continuous operation the edge of the elongate blade-like crimping member 74 will, under the constraint of the link 80, have a path of travel as represented in FIG. 18. This path may be described as comprising a very unsymmetrical figure-of-eight pattern with the upper lobe very small compared to the lower lobe and flattened, and with the angles included in the two lobes at the crossing being sharply acute.

The direction of travel of the member 74 around the path is in the direction indicated by the arrows. FIG. 19 is an enlargement of a portion of the path shown in FIG. 18, with added representation of the operative edge of the blade-like member 74 in association with the dots delineating the path. FIG. 19 includes the solid line 291 as a representation of the path of travel of the blank supporting plate 236. Also, FIG. 19 shows successive positions of the side seam sealing tab 24 of an advancing blank 10 in its relation to the path of movement of the crimper member 74. It will be noted that the crimping member 74 approaches the tab 24 from the right and from behind the line of travel of the blank. It overtakes the sealing tab 24, because of the compound control applied by the crank arm 76 and the link 80, engages the outside surface of the tab, and pulls it across the line of travel of the blank, thus flexing the tab.

Returning for a moment to consideration of FIG. 15, it will be noted that the radius of the circle of rotation of the edge of the restraint member 82 exceeds the distance from the axis of the shaft 84 on which the restraint member 82 is mounted, to the upper edge of the crimper assembly 70 as viewed in FIG. 15. The carton blank carrier transports the blank very close to the inner wall of the crimper assembly 70, so that in rotating counter-clockwise as viewed in FIG. 15, the edge of the restraint member 82 is brought into contact with the fact of the blank, the pivotal mounting of the restraint member 82 on the hub 278 permitting the restraint member 82 to rock clockwise about its mount. The cycle of rotation of the hub 278 relative to the movement of the carton carriers is so coordinated that the edge of the restraint member 82 comes into contact with a blank being advanced by a carton carrier at the scoring line delineating the tab 24. Immediately following contact of the edge of the restraint member 82 with the indentation line delineating the sealing tab, the restraint member 82 begins clockwise movement on its pivot because the hub 278 continues to rotate in counter-clockwise direction. The torsion springs 279 yield to accommodate this relative movement. As this is occurring, the blank is continuing to advance and the result is that the edge of the restraint member 82 remains in registry with the scoring line, and provides a firm edge against which the flexing is localized, while the blank continues to advance and the blank and the restraint member 82 advance in unison for a brief interval. It is during this interval that the crimper member 74 deflects the sealing tab 24 into a position at or approaching an angle of 90° relative to the blank. By the time an angle of 90° has been reached and in fact somewhat before that angle is reached, the component of the force applied by the crimper member 74 to the blank that is directed at right angles to the path of travel of the blank and thus in a direction tending to dislodge the blank from the carrier has diminished to insignificance and the assistance of the restraint member 82 is no longer required. As the operation of the components of the crimper station 70 continues, the shaft 278 withdraws the restraint member 82 from contact with the blank and as indicated in FIG. 19 the blade-like crimper member 74 continues to travel at a faster rate than the blank and folds the sealing tab 24 back toward the almost into surface contact with the side wall panel element of the blank with which the tab 24 is associated. As the carton blank carrier continues to advance it draws the blank away from the crimper blade 74 and that blade continues through the path shown in FIG. 18, while the next carton blank carrier is advancing into cooperative relation to the sealing tab crimper mechanism.

POSITIONING OF MANDREL

Figure 20:
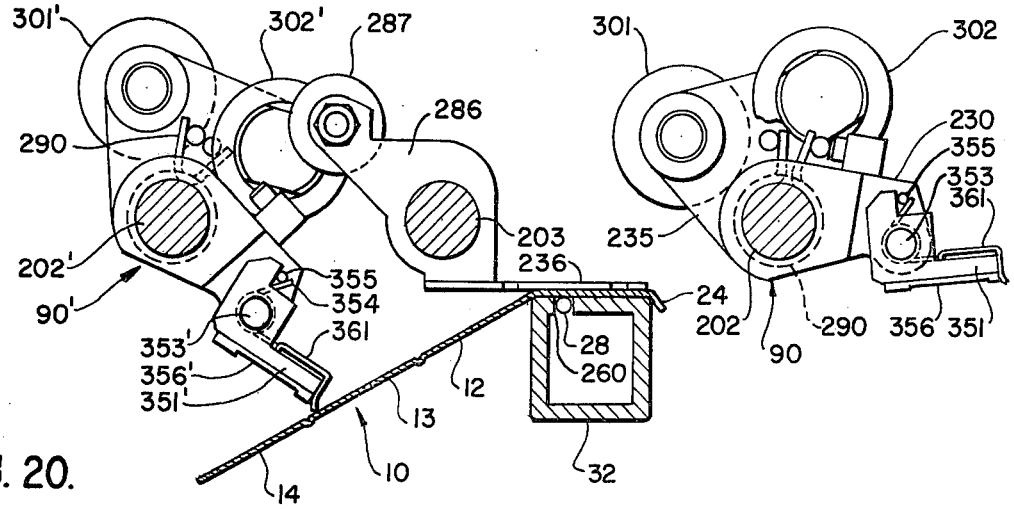
FIG. 20 is a top plan view partly in section showing in stop-action manner an instantaneous operative condition of a portion of a carton blank carrier and a following carbon blank carrier.
Figure 23:
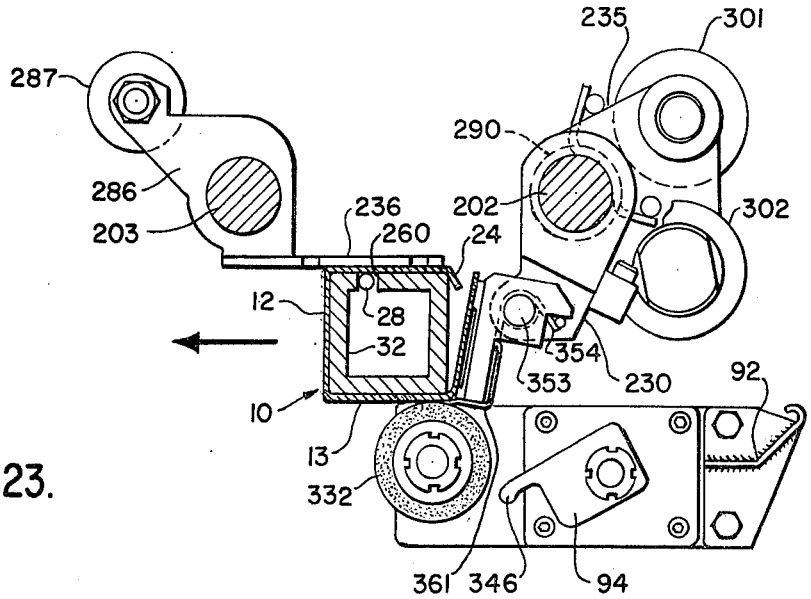
FIG. 23 is a top plan view, partly in section, showing a different instantaneous condition of the carton carrier and carton forming station slightly later than that shown in FIG. 22.
Figure 24:
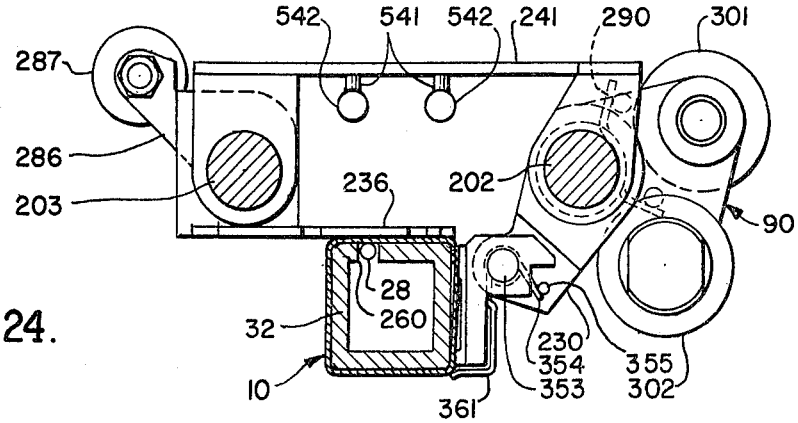
FIG. 24 is a top plan view, partly in section, of a portion of a carton carrier at a time later than that shown in FIG. 23.

Referring back to FIGS. 12 and 14 and also to FIGS. 20, 23, and 24, the hub 237 for the carton blank carrier 236 has a leftwardly and rearwardly extending arm 286 which is provided at its free end with a cam follower roller 287. Following the flexing of the side seam ceiling tab 24, the cam follower roller 287 rides onto a cam bar 288 (FIGS. 10A and 11) and rocks the arm 286 on the blank carrier plate 236 in counterclockwise direction through a small angle. This rearward displacement of the blank carrier plate 236 is in a direction away from the path of the mandrel 32 and is preparatory to the lowering of the mandrel so that it will not come into contact with the carton blank and dislodge it from the carrier plate 236.

While the cam follower roller 287 is transversing the cam bar 288 and the blank carrier plate 236 is retracted, the cam follower roller 226 that is rotatably associated with the upper slide member 222 and that rides in a cam tract 289 that is shown in cross section in FIG. 14 and in elevation in FIGS. 12, 8 and 9, encounters and rides along a downward slope 292 in the cam channel designated generally by the reference numeral 289 in which it rides, and the mandrel is lowered a sufficient distance to bring its lower end to the lower end of the carton panel 11 which carries the upper and lower carton closure panels 18, the position of the mandrel after being lowered being represented in FIG. 2. It is to be noted that the cam track 289 extends completely around the apparatus in a configuration conforming to the pattern of FIG. 7. When the cam roller 287 rides off the end of the cam bar 288 the carton blank carrier plate 236 is rocked in clockwise direction as viewed in FIGS. 20, 23 and 24 by its biasing spring 240 to clamp the blank between the plate 236 and the mandrel 32.

Since it is contemplated that the blank 10 may have a sipper 28 attached thereto prior to the lowering of the mandrel, it will be apparent that the mandrel must be provided with a clearance aperture in its wall that confronts the carrier plate 236, in order that the sipper shall not be crushed by the mandrel. The clearance aperture may take the form of a shallow elongate groove or a slot cut completely through the wall of the mandrel, depending upon the thickness of that wall. Such a groove or slot is shown in dotted lines in FIGS. 12 and 14, and is designated by the reference numeral 260.

CARTON FORMING APPARATUS

Referring again to FIG. 12, and also to FIGS. 20, 23 and 24, the lower arm 234 of the carton forming rocker assembly 90 rotatably supports at two different angular positions relative to the arm 233, the cam follower rollers 301 and 302, the former being positioned below the arm 234 and the latter being positioned above the arm 234. The lower and upper rollers 301 and 302 cooperate with the cam bars 304 and 303, respectively, both of these cams being shown in FIG. 10A and FIG. 11. A torsion spring 290 biases the carton forming rocker assembly 90 in counter-clockwise direction. The normal or idle position of the assembly 90, from the standpoint of its rotative movement about the rod 202, is the position shown at the right in FIG. 20, this position being established by a stop against which the torsion spring 290 biases the assembly 90.

The function of the two cams 303 and 304 is to move the carton forming assembly 90 from the position shown in FIG. 20 to the position shown in FIG. 23, where there is a dwell of considerable duration, and ultimately into the position shown in FIG. 24.

Due to the steep rise in the cam 303, the carton forming assembly 90 is rocked rapidly, as the carton blank carrier 60 is advanced toward the position shown in FIG. 23. By the time the cam follower roller 302 has reached the top or apex of cam 303, where there is a short dwell before the cam drops away, the cam follower roller 301 has been brought into a position to be picked up by the cam 304.

The shafts 202 and 203 in FIG. 20 and the mandrel 32 are components of one carton blank carrier 60. At the left of FIG. 20 is shown a portion of another rocker assembly, designated 90', pivotally mounted on a shaft 202'. The shaft 202' and the assembly 90' are components of the carton carrier that is ahead of, in sequence on the chain 50, the carton carrier comprising the rods 202 and 203 in FIG. 20. The spacing between the rods 202 and 202' in FIG. 20 represents scale spacing on the basis of the previously mentioned spacing of the successive carton carriers on ten-inch centers for a blank for form a 2-inch square carton. Although there might appear from the showing in FIG. 20 that the rotative motion of the assembly 90' on the shaft 202' will be prevented by components on the rod 203, such is not the case because it may be noted by reference to FIG. 12 and by the showing of the three cam bars 288, 303 and 304 in FIG. 11 that the cam follower rollers 301 and 302, on the arm 234 of the rocker assembly 90, are below the arm 286 on the rod 203 and below the cam follower roller 287 supported by the arm 286. There is sufficient clearance to permit the carton carrier assemblies to be as close together as indicated in FIG. 20 and still function in the intended manner.

The significance of this is that, as may be observed in FIG. 20, almost one-half of a blank being carried to the carton forming station by a carton carrier assembly 60 extends in front of the carton forming rocker assembly 90' of the carton carrier ahead of it in the sequence. The result is that when the carton forming assembly 90' begins to be rocked in clockwise direction through the cooperation of its cam follower roller 301' with the cam bar 303, it brushes against the back of the blank 10 carried by the following carton carrier assembly and disengages the blank from the retainer blocks 248 and 253 by which it had been held on its carton blank carrier plate 236, the spring 256 yielding to permit the movement, in opposite directions, of the arms 246 and 251 by which the blocks 248 and 253 respectively are carried, the blank being flexed generally about the scoring or indentation line 16 delineating the two carton side wall panels 12 and 11 (FIG. 1).

Figure 22:
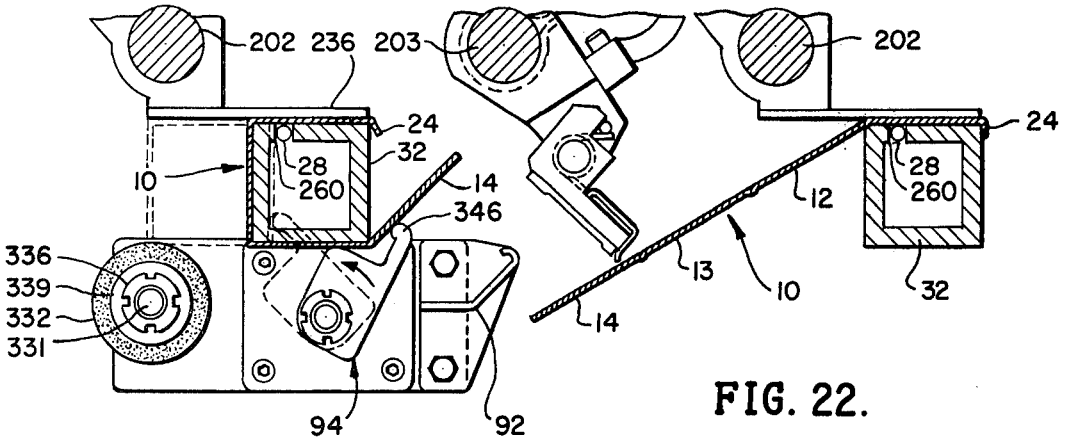
FIG. 22 is a top plan view showing in stop-action manner an instantaneous condition of the carton forming station and a fragment of the carton blank carrier following the one that is in cooperation with the carton forming station.
Figure 21:
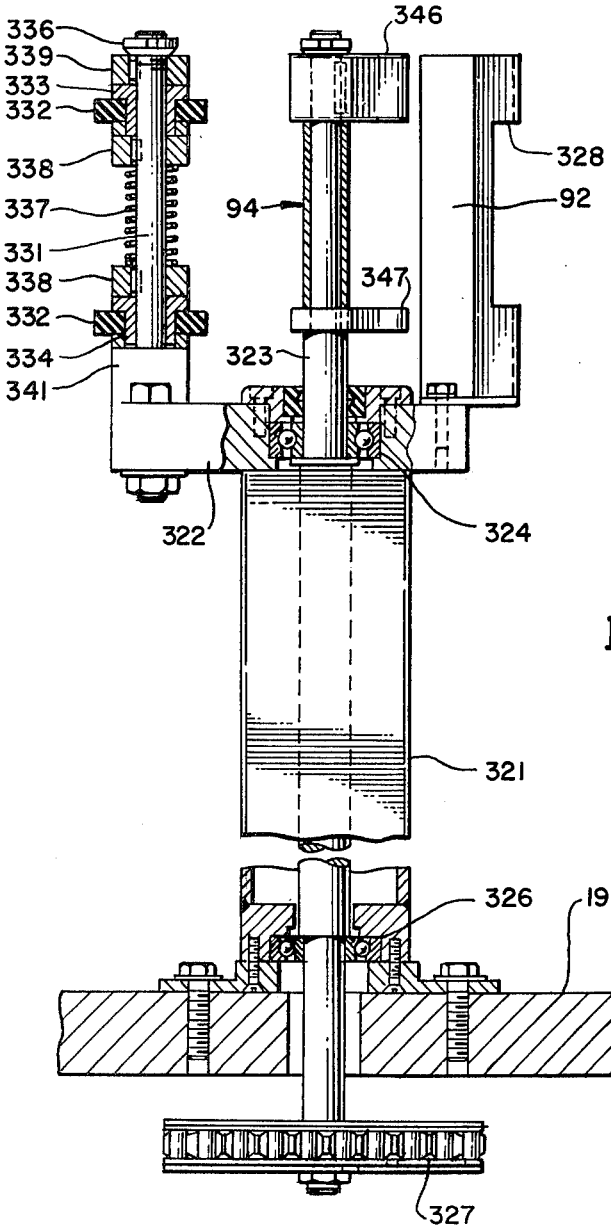
FIG. 21 is an elevational view, partly in the section, showing the carton forming station.

Turning now to FIGS. 21 and 22, there is shown therein the carton forming station which includes the previously identified barrier 92 and the carton forming rotatable member 94. The supporting components for the carton forming station are a stand 321 and a platform 322 surmounting the stand. At its right hand end the platform 322 has secured thereto the barrier member 92 which, it will be observed in FIG. 22, stands in the path of the approaching carton blank 10 which has been disengaged from the retainer blocks but is held securely in position by virtue of the fact that the blank is clamped between the carton blank carrier plate 236 and the mandrel 32 of the carton carrier assembly that is at the right of the carton forming stand in FIG. 22 and is approaching the carton forming stand.

The rotatable carton forming can assembly 94 is mounted at the upper end of a shaft 323 that is mounted in upper and lower bearings 324 and 326 in the stand 321 and that has at its lower end a gear 327 driven by intermediate gearing by the chain 50. The power take-off sprocket 56 and shaft 58 (FIG. 7) are a suitable source of driving power for the gear 327. The driving of the carton forming cam assembly 94 is like that of the shaft 78 that drives the side seam tab crimping blade 74, and the speed of rotation in relation to the movement of the carton carrier assembly 60 is the same for both shafts, namely one revolution of the shaft 323 for advancement of the chain 50 a distance equal to the spacing of the carton carrier assemblies.

On the opposite side of the carton forming cam assembly from the barrier 92 is a drag roll assembly comprising a vertically mounted stationary shaft 331 on which drag wheels 332 are carried by bushings 333 and 334. The top of the shaft 331 carries a lock nut 336 and a compression spring 337 thrust upwardly through a thrust washer 338, through the upper bushing 333 and a thrust washer 339 against the lock nut 336. Downwardly the spring thrusts through a lower thrust washer 338, and the lower bushing 334 against stationary member 341 secured to the platform 322. The compression spring, operating against both of the sleeves 334, causes the wheels 332 to offer resistance to rotation by frictional engagement by a passing carton blank.

When the approaching blank 10 encounters the barrier 92, the blank is further flexed about the scoring line delineating the side wall panels 11 and 12 until the side wall panel 12 comes into surface contact with the advancing side of the mandrel 32. As the carton carrier assembly continues to move, the barrier 92 flexes the blank about the scoring line 16 delineating the side wall panels 12 and 13, as the outer face of the mandrel 32 passes across the edge of the barrier 92. As the blank approaches the rotary cam assembly 94 the blank 10 is wrapped around three sides of the mandrel 32 and the side wall panel 14 of the carton blank is trailing.

The rotary cam assembly 94 is provided with upper and lower cams 346 and 347, respectively, and the rotative relation of the cam assembly 94 to the advancing mandrel 32 is such that, as shown in FIG. 22, the tip of the cam 346 and of course its companion cam 347 below swing into the right of the mandrel 32 and overlap its right side a short distance. As is indicated by the dotted-line showing of the cam 346 and the trailing face of the mandrel 32 in FIG. 22, the tip of the cam closely follows the right hand face of the mandrel 32 until the mandrel has moved out of range. As the cams 346 and 347 swing in behind the moving mandrel 32 they flex the last of the four carton side wall panels, the panel 14, about the scoring line 16 delineating the panels 13 and 14, thus swinging that side wall panel of the blank into confronting relation to the right hand face of the mandrel 32.

Referring again particularly to FIG. 12 it will be noted that the arm 233 on the carbon forming rocker assembly 90 is bifurcated and a lever arm 351 extends outwardly from the bifurcation in the arm 233 and is retained therein by a spherical bearing 352 through which passes a bolt 353 which supports above and below the arm 233 the torsion springs 354. At its outer end the arm 351 supports a vertically disposed pressure plate 356. One of the torsion springs 354 is seen in FIGS. 20, 23 and 24, and the torsion springs 354 bias the arm 351 and with it the pressure plate 356 in clockwise direction as viewed in FIG. 16. A stop pin 355 determines the normal or idle position of the arm 351 relative to the bifurcated arm 233 but permits counter-clockwise movement of the arm 351 relative to the arm 233. The mounting of the arm 351 within the bifurcation of the arm 233 and in association with a spherical bearing 352 introduces the possibility of a slight amount of wobble as between the arm 351 and the arm 233 so that the pressure plate 356 may be self-aligning, as will be described hereinafter.

As may be observed in FIG. 12 the pressure plate 356 is not rectangular but is cut away at its upper and lower outer corners so that at its outer edge its height is less than the full height at its left edge. The narrow portion of pressure plate 356 at the right is related to a wide but shallow notch 328 in the outer edge of the barrier 92 which wraps the blank 10 around the mandrel 32, as well as to the space between the upper and lower cams 346 and 347 of the rotary cam assembly 94 and the spacing between the drag rollers 332.

To the back of the lever arm 351 two leaf springs 361 are clamped, the upper edge of one generally coinciding with the upper edge of the narrow portion of pressure plate 356 and the lower edge of the same part of the pressure plate. The outer or free ends of the leaf springs 361 are bent inwardly substantially at right angles to overlie the edge of the pressure plate 356 and just beyond their point of overlie relative to the edge of the pressure plate 356, they are bent outwardly slightly.

Returning now to consideration of FIGS. 21 and 22, and assuming that the left-hand mandrel 32 is approaching the position shown at the left of FIG. 22, the blank 10 that is associated with that mandrel has already been flexed by the barrier member 92 so that the side wall panel 13 of the blank is in close proximity to the front face of the mandrel 32 and the side wall panel 14 of the blank is trailing. The rounded corners of the cam members 346 and 347, that are preceding in the direction of rotation the tips of those members, closely press the side wall panel 13 of the blank 10 into engagement with the face of the mandrel 32 as the tips swing in behind the moving mandrel. As the cam tips move in they flex the trailing side wall panel 14 of the blank rearwardly of the mandrel 32 as a first step toward bringing that side wall panel of the blank into contact with the right hand side of the mandrel 32. As previously mentioned the rotational velocity of the rotor 94 is such that the tips of the cams of the cam assembly 94 follow the mandrel closely. By the time the tips of the cams 346 and 347 have reached their dotted line position as shown in FIG. 22, the leading side of the mandrel 32 has reached the drag rollers 332 and as the mandrel continues its movement these rollers press the side wall panel 13 of the blank against the face of the blank against the face of the mandrel 32.

During the wrapping of the blank about the mandrel by the barrier 92 and the cam assembly 94 the upper cam follower roller 302 on the carton forming arm 234 of the rocker assembly 90 (FIG. 20) is riding on the shallow slope of the cam 303 so that the angular movement of the assembly 90 in clockwise direction is initially very gradual and the position of the rocker assembly 90' at the left of FIG. 20 is a close approximation of the position of the assembly when the cam assembly 94 has reached the position shown in FIG. 22. When the cam follower roller 302 encounters the steeply sloping portion of the cam bar 303 (FIGS. 10A and 11) the rocker assembly 90 is quickly swung around toward but not into the position shown in FIG. 23. Before the cam follower roller 301 has an opportunity to drop off the dwell at the apex of cam 303 the cam follower roller 301 is picked up by the cam 304 and clockwise rotation of the rocker assembly 90 on the rod 202 continues, at substantially the same angular velocity as the cam 303 imparted to it. The clockwise rotation of the rocker assembly 90 on the rod 202 is taking place while the mandrel 32 is traversing and blank wrapping components in FIGS. 21 and 22 comprising the barrier member 92, the cam assembly 94, and the drag rollers 332. The clearances afforded by the shallow notch 328 in the barrier 92, the space between the cams 346 and 347 on the cam assembly 94 and the spacing between the drag rollers 332 are such that the free edge of the pressure plate 356 and the ends of the leaf springs 361 do not collide with any of the components shown in FIG. 22.

FIG. 23 shows the position of the rocker assembly 90 relative to the mandrel 32 and the carton blank 10 which has been wrapped around the mandrel at the time that the cam follower roller 301 reaches the top of the slope on cam 304. When it reaches this position the tips of the leaf springs 361 have been brought into engagement with the outer surface of the blank 10 at the corner between the side wall panels 13 and 14 and because of the flexibility of the leaf springs they may ride up on the corner. The pressure plate 356, in coming into this position, has come into engagement with the outer surface of the side wall panel 14 of the blank and has flexed it into a narrow angular position relative to the right hand side of the mandrel 32. In this position the inner surface of the side wall panel 14 of the blank 10 adjacent to the free edge thereof is closely confronting the side seam sealing tab 24 of the blank 10. It will be noted that some tolerance is permissible as between the occurrence of pressure contact between the forward edge of the pressure plate 356 and the right hand front corner of the mandrel 32, with the carton blank 10 confined between the two, and the arrival of the cam follower roller 301 at the top of the slope on the cam 304. Because the pressure plate 356 is carried by the pivotally mounted arm 351 on the rocker assembly 90 further clockwise movement of the assembly 90 on the rod 202 is permissible and will later occur, with the mounting arm 351 for the pressure plate 356 rocking further counter-clockwise relative to the arm 233 on which it is pivotally mounted until the gap between the side wall panel 14 of the carton blank 10 and the side seam sealing tab 24 ultimately has been closed, this condition being shown in FIG. 24. It will be noted that the cam 304 has a nearly semicircular dwell, and during the traversal of this dwell, the position of the side wall panel 14 of the carton blank 10 relative to the side seam sealing tab 24 will be maintained as shown in FIG. 23. The tips of the leaf springs are held in slightly over-lapping contact with the outer surface of the side wall panel 13 of the blank 10, and thus that side wall panel of the blank is maintained in contact with the front face of the mandrel 32.

The geometry involved in the stationary cam 304 has unobvious aspects that will now be considered. First it should be noted that the movement of the axis of rotation of the cam follower roller 301 about the axis of the blank carrier rod 202 is orbital while the carrier is traveling in a straight line and the rocker member 90 is being rocked clockwise (as viewed in FIGS. 20, 22 and 23) by the cooperation of the cam follower roller 302 with the stationary cam 303. The carrier is still traveling in a straight line at the time that the rocker member 90 has been brought into the position shown in FIG. 23, with the pressure plate 356 angularly confronting the trailing face of the mandrel 32 and the leaf springs 361 hooked to the corner of the mandrel. It should be noted that the axis of the cam follower roller 301 is trailing the blank carrier rod 202. When the carton blank carrier goes from the straight line portion of its travel to the arcuate portion, the rod 202 is turned clockwise on its axis as the rod 203 leads the rod supports 206 and 207 into the curve. This turning is a change relative to the path of travel of the rod. Simply stated, the change is that a plane through the axis of the rod 202 intersecting the straight line travel at right angles will not, at its point of intersection with the circular arc portion of its travel, be perpendicular to a tangent to the circular arc at that point, but will be displaced in clockwise direction from perpendicularity to that tangent.

If instead of being pivotally mounted on the rod 203, the rocker member 90 were locked to that rod, the axis of cam roller 301 would be subjected to further orbital movement in clockwise direction, not caused by either of the cams 303 and 304, but solely by the turning of the rod 202 on its axis. Since the rocker member 90 is pivotally mounted on the rod 203, the carrier 60 enters the circular arc portion of its travel with the rocker assembly 90 controlled only by the cam 304. Were that cam to have only sufficient rise to accomplish the condition shown in FIG. 23 with the carrier 60 traveling in a straight line, the condition would not be maintained when the carrier 60 goes into the curved portion of its travel, the rocker assembly 90 would not turn with the rod 202 as if locked to it, and the pressure plate 356 would be retracted from its carton blank holding position. Accordingly, the rise in the cam 304 is comprised of two component portions, a first portion to establish holding of the blank with the carrier 60 in its straight line travel and a second portion to compensate for the transition from straight line to arcuate travel of the carton blank carrier.

When the carton blank carrier 60 completes its travel around the semi-circular path and enters a straight line path, the rocker member 90 is oppositely affected. As the rod supports 206 and 207 enter the straight line path, they turn the rod 302 counter-clockwise on its axis relative to the arcuate path of travel of the rod.

If the relationship of the pressure plate 356 to the mandrel 32 that is shown in FIG. 23 were to continue in the straight line travel of the blank carrier 60, it would be necessary to provide a decline in the cam 304 incident to entry of the carrier 60 into its straight line travel. However, it is required, as will be more fully described hereinafter, that the pressure plate be brought into the position shown in FIG. 24 as the carrier comes out of its arcuate path of travel. Counter-clockwise turning of the rod 202 within the rocker member 90, the latter being restrained by the cam 304 and cam follower roller 301 from a corresponding turning, results in relative clockwise rotation of the rocker member 90, closing the angle of confrontation of the pressure plate 356 with the mandrel 32 and pressing the side wall panel 14 of the blank into contact with the side seam sealing tab 24. As may be seen in FIG. 10A, at the approach to resumption of the straight line travel of the carrier 60, the surface of cam 304 recedes from its circular arc portion. Completion of operation of the rocker member 90 is accomplished by more sharply curving the surface of cam 304 from its circular arc into a straight line.

As shown in FIG. 10A, the portion of the cam 304 that includes the transition curve from the circular arc portion to the straight line portion, and designated by the reference numeral 304', may be made a separate piece from the cam 304, attached thereto by bolts 306 passing through slots 307 with compression springs 308 confined in confronting socket holes between stationary portions of the apparatus and the cam member 304', to thrust that cam member outwardly. The movable cam bar 304' provides a yield or relief in the application of pressure of the pressure plate 356 against the mandrel 32 by the cam follower roller 301. This compensates for any minor variations that there may be in the cooperative components of the several carton blank carriers 60 and assures avoidance of the application of excessive pressure against a mandrel in situations where the cumulative effect of tolerance deviations might result in the application of excessive pressures. The springs 308 absorb any such excessive pressures that may develop.

SIDE SEAM HEATER

Figure 25:
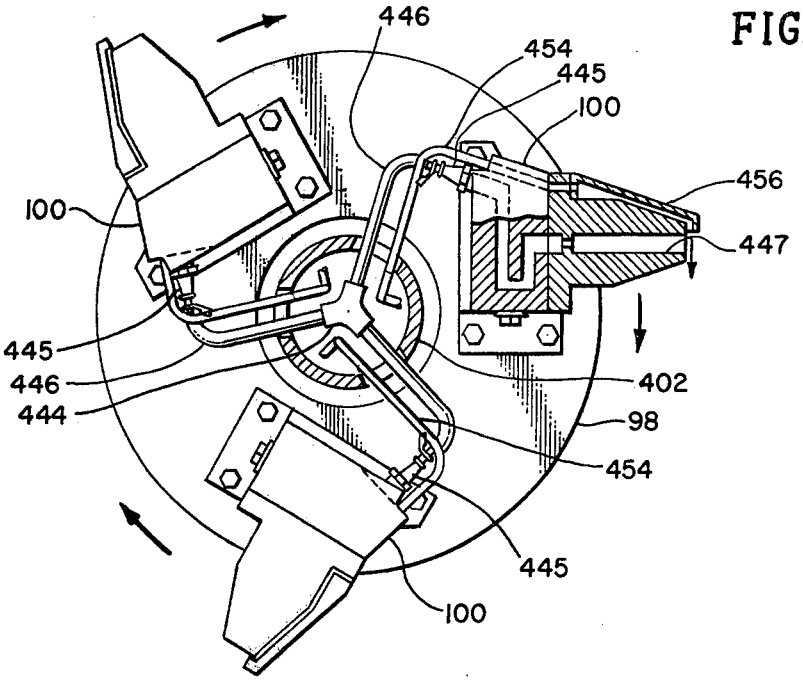
Figure 27:
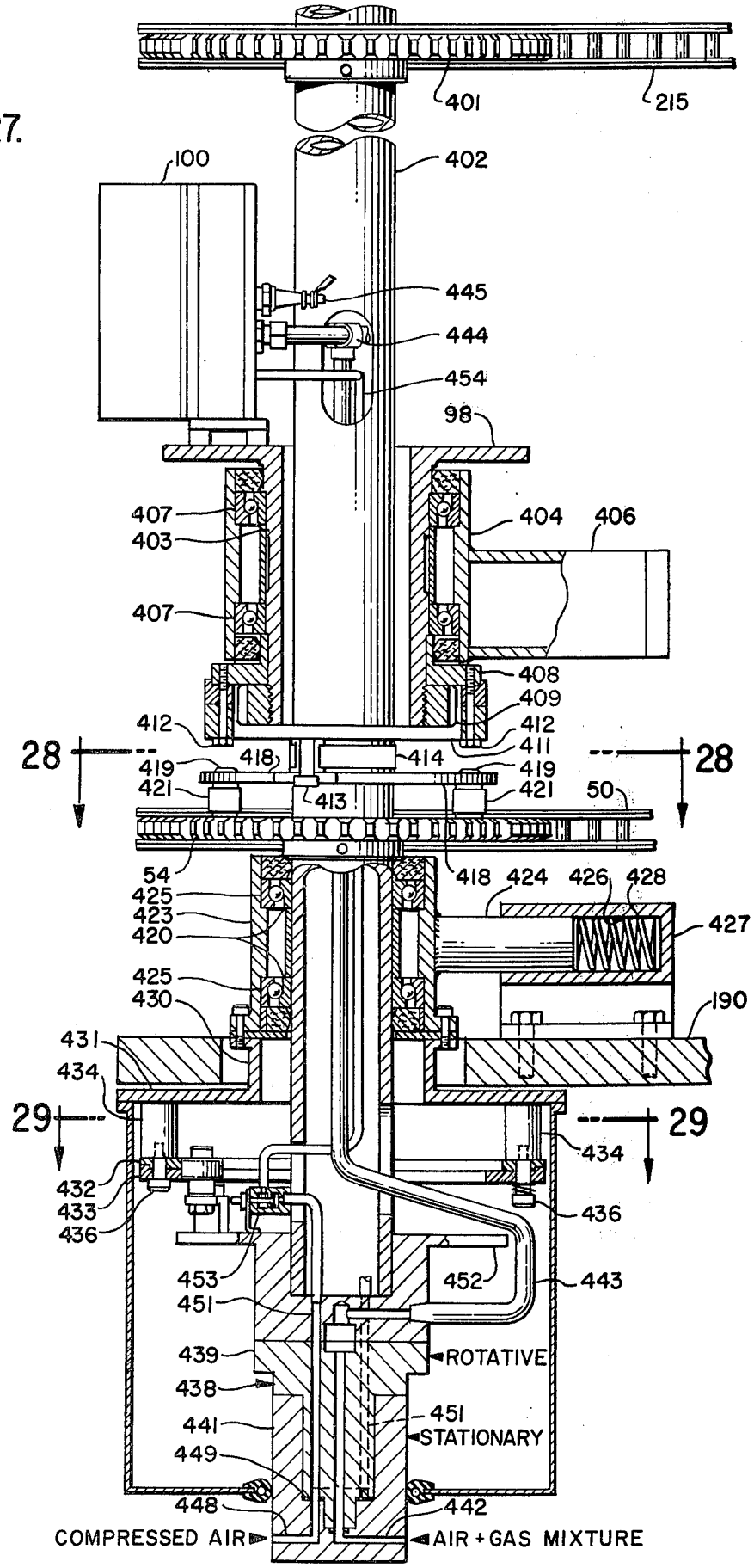
FIG. 27 is an elevational view, partly in section, of the side seam heater operating mechanism.

Returning now to consideration of the heating of the side seam sealing tab 24 and the inner surface of the side wall element 14, following the presentation of that side wall element in angular confrontation with the trailing side of the mandrel 32, and referring particularly to FIGS. 25 and 27, the reference numeral 98 designates a rotatable platform or turntable which mounts a plurality of heater units 100. These components were previously identified by these reference numerals in FIG. 7. In relation to the configuration of the entire carton forming apparatus as seen in FIG. 7 and also in FIGS. 10A and 10B, the optimum number of heater units 100 that the rotatable platform 98 will accommodate is three and FIG. 25 shows that number of heater units. FIG. 27 also shows in their spatial relation the sprocket 54, also shown and identified in FIG. 7 together with the lower driving chain 50, and the upper driving chain 215, these two chains also being shown in FIG. 14. An upper idler sprocket for the chain 215, that is coaxial with the sprocket 54, is designated by the reference numeral 401. The sprockets 54 and 401 are both driven sprockets and although not previously mentioned, it will be understood that above the sprocket 52, shown in FIG. 7 as being mounted upon the driving shaft 51, there would be a companion upper sprocket meshing with and driving the upper chain 215.

The sprockets 54 and 401 are secured, such as by keying, to a hollow tubular shaft 402 that passes through a clearance hole in the turntable 98. The turntable is supported on a depending hub 403 that is rotatably supported in a stationary housing 404 that is mounted on a bracket 406 that may be attached to a stationery framework portion of the machine, such as to the left-hand post 192 shown in FIG. 10A. The diameter of the bore of the hub 403 is greater than that of the shaft 402 so that the hub 403 is not connected directly to the shaft 402. Antifriction bearings 407 rotatably support the hub 403 within the stationary housing 404 and perform a thrust bearing function so that the turntable 98 is supported at the desired height within the apparatus.

At its lower end the hub 403 is fitted with a flange ring 408 which is forced into engagement with the inner race of the lower antifriction bearing by a clamping ring 409 threadedly engaging the hub 403. A drive connection plate 411 is secured to the flange ring 408 by bolts 412. The plate 411 has a pair of depending pivot pins 413 (FIGS. 27 and 28) that are pivotally connected by links 414 to pivot pins 416 on a notched disk 418. In turn, the disk 418 is provided with pivot pins 419 that are connected by links 421 to pivot pins 422 that are upstanding on the sprocket 54.

Figure 28:
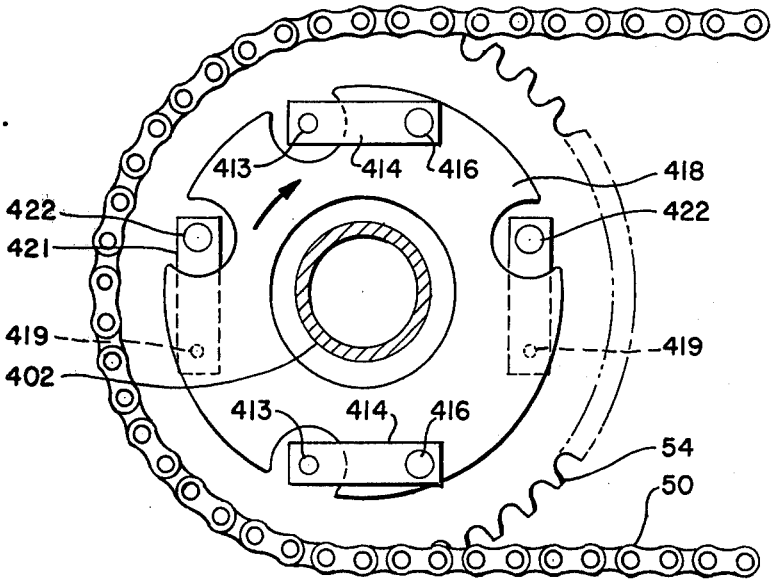
FIGS. 28 and 29 are plan views taken generally on the lines 28—28 and 29—29, respectively, of FIG. 27.

It will be noted by reference to FIG. 28 that the pivot pins 413 at the bottom of the hub 403 for the turntable 98 are not diametrically opposite each other nor are the pivot pins 416 on the disk 418 diametrically opposite each other. Instead, the two pivot pins 413 and two pivot pins 416 are relatedly located at the four corners of a parallelogram, two sides of which are the links 414 and if the disk 418 is centered with the hub 403, that parallelogram is a rectangle. Considering that the hub 403 has a fixed axis of rotation because the hub is supported in bearings from the framework of the apparatus, the disk 418 may shift laterally either way from a coaxial relationship with the hub 403 under the constraint of the links 414. Similarly, the two pivot pins 419 on the disk 418 and the two pivot pins 422 on the sprocket 54 are at the corners of a parallelogram with the pins 419 at the ends of one of the long sides of the parallelogram and the pins 422 at the ends of the other long side.

No mention has been made previously of bearings for supporting the tubular shaft 402. As shown in FIG. 27, a bearing comprising inner and outer races 420 and 425 is fitted to the tubular hollow shaft 402 above the table 190. The bearing races are contained in a housing 423 which is secured to a cylindrical plunger-like rod 424 that is slidable in a matching bore 426 in a bracket 427 that is secured to the table 190. The rod 424 is backed by a compression spring 428 which serves as a spring loading for the bearing to urge it leftwardly and maintain the chain 50 taut. A similar spring loaded bearing (not shown) is provided for the hollow tubular shaft 402, above sprocket 401, to keep the upper chain 217 taut.

The employment of spring biased bearings for the shaft 402 gives rise to the possibility of and the accommodation for shifting of the shaft 402 within the driving structure for the turntable platform 98. The disk 418 and the links 414 and 421 serve as a flexible or yieldable coupling between the shaft 402 and the hub 403, and any lateral shifting of the shaft 402 within the hub 403 will be absorbed as changes in the parallelograms of interconnection between the driving and driven elements and the disk 418, accompanied by lateral shifting of the disk 418.

Figure 29:
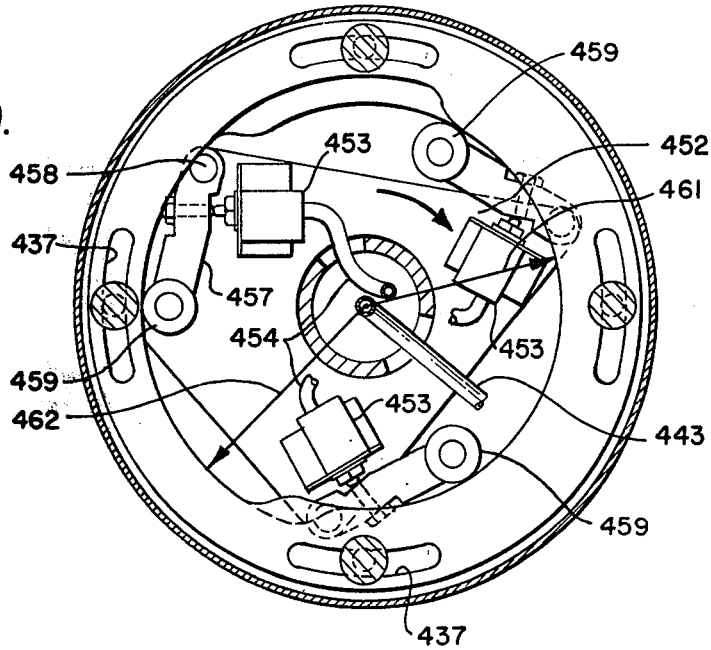

Referring again to FIG. 27, the reference numberal 431 designates a plate which is suspended from the bearing housing 423 by any convenient means such as a collar 430. The plate 431 has suspended therefrom stationery components of a fuel supply controlling system comprising a pair of superimposed rings 432 and 433 which are also seen in FIG. 29. The rings 432 and 433 are suspended from the plate 431 by hangers 434 and are clamped to those hangers by screws 436. The rings 432 and 433 together form a timing cam. At least one of the rings, and as shown in FIG. 29 it may be the upper ring 432, is provided with elongate slots 437 through which the screws 436 pass to provide variable rotative orientation of one with respect to the other to provide for adjustment of the length of a dwell of the cam as will be described hereinafter.

As may be seen in FIG. 27 the hollow tubular shaft 402 is secured to and imparts rotation to the rotative portion of a rotary union, designated generally by the reference numeral 438, for supplying gaseous material from a stationary source of supply to the heater units 100 on the turntable 98. The rotary portion of the union is designated by the reference numeral 439.

The stationary component 441 of the rotary union has two input ducts, one, designated by the reference numeral 442 entering the stationary portion 441 and rising vertically and axially through the rotating portion 439 of the rotary union into the upper portion thereof where it is connected by a conduit 443 that enters the hollow tubular shaft 402 through an aperture in the wall. The conduit 443 emerges from the hollow tubular shaft 402 through an aperture above the turntable 98 and is there connected to a manifold 444 from which a connection is made through tube 446 to the combustion chamber 447 of each of the heater units 100. A mixture of air and gas suitable for supplying sufficient heat at the nozzle at each of the burners is supplied through the conduit 443 and through the manifold 444 to the three burner units. There is no valving between the input of air and gas mixture to the rotary union and the burners and it is contemplated that they shall burn continuously when the system is in operation, valving being done externally of the rotary union. Each of the burner units may be provided with an igniting device, such as a spark plug 445, for igniting the combustible mixture supplied to the burner.

The stationary portion 441 of the rotary union has a second entry passage 448 through which compressed air from an external source is supplied. The passage 448 rises into communication with a manifolding sealing ring 449 seated in the stationary portion 441 of the rotary union and upon which a shoulder of the rotative portion 439 of the rotary union rests. Three passages 451 rise through the rotative portion 439 of the rotary union 438 and emerge above a plate 452 which is secured to the top of the rotary portion 439 of the rotary union 438 and accordingly rotates with it and with the hollow tubular shaft 402.

Each of the passages 451 rising above the plate 452 is connected to one of three air valves 453. From each of the air valves 453, a connection tube 454 enters the hollow tubular shaft 402 through an aperture in the wall at the lower end, rises above the turntable 98, emerges from the shaft 402 through an aperture, and connects to the interior of a jacket 456 that is attached to one side of each of the burner units 100 and that has an exit orifice 455 facing across the heater nozzle. With compressed air directed through the passage just traced and emerging from the jacket in a direction crossing the nozzle of the heater, an air curtain is established which deflects flame or combustion products and heated air emerging from the nozzle of the heater at right angles to its direction of emergence from the heater to heat the side seam components of the carton. The compressed air emerging from the jacket and blowing across the nozzle of the heater may have a cooling effect when mixing with the products of combustion emerging from the heater so that the tendency to heat components of the apparatus due to continuous firing of the heater may be lessened and the products of combustion mixed with the compressed air may be dissipated in the air and no exhaust duct is needed. More importantly, however, the air curtain may be controlled to deflect the heat laterally except when the heat is aimed directly into the wedge of space between the carton wall panel and the mandrel. This will prevent undesired heating of carbon blank and metal when a mandrel is entering and leaving its cooperative association with a heater and the heat is directed other than straight-forwardly into the abovementioned web of space.

The timing of the admission of compressed air to the deflection jackets of the heaters is controlled by the timing rings 432 and 433 in FIGS. 27 and 29. Referring particularly to FIG. 29 it will be seen that each of the air valves 452 has an associated operating lever 457 which is pivoted on a pivot pin 458 on the plate 452 and which is provided at its free end with a cam follower roller 459 that is of sufficient width to engage the inner surfaces of both of the timing rings 432 and 433.

Each of the timing rings has a dwell at lesser radial distance from the axis of rotation of the shaft 402 represented by the radius line 461 in FIG. 29 and a dwell at a greater radial distance represented by the radius line 462. The lower timing ring 433 has a shorter dwell at maximum radial distance than the upper ring 432 and the end of that dwell on the ring 432 is so far beyond the end of the dwell on the ring 433 that the lengths of the slots 437 in the upper timing ring 432 will not accommodate counter-clockwise movement of the ring 432 relative to the ring 433 a sufficient distance to vary the end of the dwell as determined by the lower timing ring 433. The amount of dwell at maximum radial distance as provided by the lower ring 433 may, however, be shortened by adjustment of the beginning of the dwell at greater radial distance on the upper ring 432 relative to the beginning of the corresponding dwell on the ring 433. This is evident from the fact that as seen in FIG. 29, a portion of the dwell of maximum radius of the ring 432 is shown in dotted outline at the bottom of FIG. 29 indicating that the beginning of the dwell at greater radial distance on the upper ring 432 is slightly to the left of the corresponding beginning on ring 433.

When a cam follower roller 459 is engaging the dwell at greater radial distance, the valve is closed to cut off the air curtain and permit the heating of the carton components that are to be sealed together to form a side seam by one of the heaters 100. When a roller encounters the dwell at lesser radial distance from the axis, the valve is opened to establish the air curtain and deflect the output of the heater laterally. From the foregoing it will be apparent that the point in the heating cycle of each of the heaters at which the heating is cut off by the establishment of the air curtain is predetermined whereas the point of beginning, accomplished by the cutting off of the air curtain, is variable depending upon the adjustment of the upper ring 432 relative to the lower ring 433. It will be understood that both rings could be made adjustable so that the point of establishment of the air curtain could also be varied. The specific timing arrangement shown in FIGS. 27 and 29 for controlling the air valves 453 provides flexibility in turning off the air curtains.

By comparison of FIGS. 25 and 27 it will be apparent that the burner units 100 have a long narrow nozzle orifice standing vertically to direct heat into the space defined by the trailing face of a mandrel 32 and the inner face of the carton side wall element 14 which angularly confronts that face of the mandrel.

It is to be noted, by reference to FIG. 25, that the aiming of the heaters 100 is not radial of the turntable 98, but instead a centerline through the chamber 447 of the heater is behind, in the direction of rotation of the turntable, a radius of the turntable parallel to that centerline. The reason for this is that the ideal aiming of the heat from the narrow orifice of the nozzle is parallel to the trailing face of the mandrel. A radially directed blast of heat would deviate somewhat from the ideal aiming.

Preceding the description of operation of the heater units 100, the control of the rocker assembly 90 by the cams 304 and 304' was described. It was set forth that as control of the rocker member transfers from the cam 304 to the spring loaded cam 304', the rocker assembly 90 is rocked the remaining distance of its clockwise rotation relative to the carton blank carrier rod 202 upon which it is pivoted to close the carton blank side wall panel element 14 into pressure contact with the side seam sealing tab 24 to effect completion of the side seam by congealing of the polyethylene coatings on the side wall panel element 14 and the side seam sealing tab 24 following completion of the melting of that coating by one of the heat units 100. This is the condition of the rocker assembly 90 and its pressure plate 356 shown in FIG. 24. Since the application of heat is no longer required when the pressure plate 356 completes the side seam of the carton, the timing ring 433 that controls the establishment of the air curtain across the nozzle of the heater unit 100 establishes that curtain about the same time as the closing of the gap between the pressure plate 356 and the mandrel 32 occurs.

CRIMPING OF BOTTOM SEALING TABS

The flexing or crimping of the sealing tabs 22 at the lower end of the blank preparatory to closure of the bottom of the carton is effected at the station 110 shown in FIGS. 7 and 9, and the components of that station as they cooperate with the advancing carton carrier are shown schematically in successive operative conditions in FIGS. 30 to 37. The components that cooperatively engage or are engaged by the sealing tabs 22 are the stationary plate 471 and two rollers or rotary cam members 472 and 473. The rotary cams 472 and 473 are secured to shafts 474 and 476, respectively, to which are also secured driving sprockets 477 and 478, respectively, that are engaged by a sprocket chain 479. The chain 479 is shown in dotted outline in FIG. 32 and is also shown in FIG. 9. The chain is driven by a sprocket 481 which is driven by intermediate gearing (not shown) from the conveyor chain 50 in a relationship of one revolution of the rotary cams 472 and 473 for advancement of the carton blank carriers a distance equal to the center spacing of the carton blank carriers from one another. The intermediate gearing for driving the sprocket 481 may be connected to the shaft 58 (FIG. 7) which is driven by the sprocket 56.

Referring now to FIGS. 30 and 31 it will be seen that the stationary plate 471 presents to the advancing carton tube on the mandrel 32 a central tongue 783 that presents an upwardly sloping surface to the oncoming leading sealing tab 22. In the path of the front or edgewise-moving tab 22 the plate 471 has its edge configured to a V-shaped notch 484 presenting an upwardly sloping surface to the oncoming tab, and on the other side of the tongue 483 the edge of the plate 471 recedes in the direction of travel of the mandrel 32 and presents an upwardly sloping surface to the tab. FIGS. 30 and 31 show the initial encounter of the leading tab 22 with the stationary plate 471 and it will be seen that the tab is first engaged centrally by the tongue 483 and is flexed against the lower end of the mandrel by that tongue initially and immediately afterward by the upwardly sloping surfaces located laterally of the tongue 483, the bending or flexing being accomplished by the movement of the mandrel 32 relative to the stationary plate 471.

It will be noted in FIG. 30 that the notched edge of the plate 471 that is presented to the advancing mandrel 32, extends forwardly and beyond the outer face of the mandrel so that the sealing tab that depends from the side wall panel 13 of the carton blank 10, which is the side wall panel that is in engagement with the front face of the mandrel, is moving edgewise and will encounter the notched edge of the stationary plate 471 and will be flexed upwardly by the camming action of the edge of the notch and by the upwardly sloping surface presented to it so that the advancement of the mandrel 32 relative to the stationary plate 471 will result in the folding of that sealing tab also into position between the lower end of the mandrel and the upper surface of the plate 471.

The rotary cams 472 and 473 rotate in the direction indicated by the arrows in the several figures and it will be seen that the cam 473 leads the cam 472 in the sequence of their cooperation with the advancing carton. The rotational speed of the two cams 472 and 473 and the distance of the tip of the cam 473 from its axis of rotation are such that the cam 473 overtakes the trailing sealing tab 22 of the carton blank after the leading tab 22 has been flexed by the stationary plate 471 and the flexing of the trailing tab 22 by the rotary cam 473 about the lower end of the mandrel 32 is shown in sequence in FIGS. 32, 33, and 34. The rotary cam 473 is provided with a slot 487 in its operating face as a clearance for the tongue 483 on the stationary plate 471 so that, as shown in FIG. 34, the rotary cam 473 may lift the trailing sealing tab 22 as that tab approaches the stationary plate 471 and permit the trailing sealing tab 22 to pass across between the top of the stationary plate 471 and the lower end of the mandrel 32, as is the leading sealing tab 22.

As the rotary cams 472 and 473 continue their counterclockwise rotation, accompanied by leftward movement of the mandrel 32, the upper edge of the leading face of the cam 472 emerges from below the stationary plate 471, it being noted that the lefthand edge of the plate 471 is under-beveled as indicated by the reference numeral 488 to permit passage of the curved upper surface of the rotary cam 472. The rotary cam 472 engages the surface of the leading sealing tab 22 and further flexes it beyond an angle of 90° and into the lower end of the mandrel 32, the lower ends of the sides of the mandrel being beveled inwardly to accommodate such bending. The stationary plate 471 is provided with a second tongue 489 extending leftwardly and this tongue is under beveled at 491 as is the rest of the lefthand edge of the plate 471 as previously described. The tongue 489 provides an overlap of cooperation as between the stationary plate 471 and the rotary cam 472 so that the cam 472 shall properly contact and flex the leading sealing tab 22 upwardly into the lower end of the mandrel 32 and shall not crush it or otherwise damage it. It will be apparent from FIGS. 35 and 36 that the rotary cam 472 requires a peripheral groove to accommodate the tip of the tongue 489. This groove is designated by the reference numeral 493 in FIG. 38.

The cam 472 is provided with a bevel or chamfer 494 at the upper end of the face that is seen in FIGS. 32, 34 to 37, and in FIG. 38 in side elevation, and this beveled surface complements the bevel inside the front wall of the mandrel, so that the cam 472 may flex the front sealing tab 22 upwardly inside the lower end of the mandrel as it does the leading sealing tab. At its right-hand side the rotary cam 472 has an undercut step 492 and this step picks up the trailing sealing tab 22 as shown in FIG. 36 and flexes it upwardly inside the mandrel 32.

It might be thought that the sealing tabs, having been flexed upwardly inside the lower end of the mandrel, might remain there when the lower closure panel is brought into bottom closure position, but this is not the case. Paperboard coated with polyethylene of the type that is employed to form containers for beverages such as milk and fruit juices has memory properties which cause it to back away from a fully flexed position when it has been flexed about an indentation line. The position of the leading sealing tab 22 in FIG. 37 is indicative of this. It will be remembered that in the flexing of the side seam sealing tab 24 as described hereinbefore the tab was flexed considerably beyond a 90° angle with respect to the wall panel element 11 but this same memory property causes the tab to return to a position in which it would angularly confront the trailing mandrel wall, as shown in FIGS. 20, 22 and 23. At the end of the sequence of operations represented in FIGS. 30 to 37, the three sealing tabs at the lower end of the blank have been flexed into positions in which their lower or outer surfaces may be engaged by the lower carton closure panel when that panel is subsequently brought into engagement with them.

COMPLETION OF SIDE SEAM OPERATION

The description of the side seam forming operation was terminated with the rocker assembly 90 rocked into the position shown in FIG. 24 with the side wall panel 14 of the carton blank clamped against the mandrel. It has been held in this position by the lower cam roller 301 on the rocker member 90 rolling along the cam surface 304'. During this time the polyethylene coating which had been melted is congealing to complete the seal between the side wall panel 14 of the carton blank and the side seam sealing tab 24. The cam bar 304' ends in a downward slope 381 which permits the torsion spring 290 to being the restoration of the rocker member 90 to its original or idle position. It will be remembered that the cam 303 initiated the rotation of the rocker member 90 from its normal position and that this rotation was transferred to the cam 304. In order that there shall be a controlled restoration of the rocker member 90 to its normal position, a cam bar 382 (FIG. 10A) is provided to pick up the upper cam roller 302 on the rocker member 90 and control the return of the rocker member 90 to normal position so that it shall not be abruptly snapped back to that position against its stop. The rocker assembly 90 must be restored to normal before the carton carrier 60 moves into cooperation with the bottom sealing tab crimping station 110, because of the possibility of collision between the rocker assembly 90 and the station 110.

PREPARATION FOR CLOSURE OF LOWER END OF CARTON

Referring now to FIGS. 12 and 14 and also to FIGS. 40 to 43, the previously identified lower slide member 226 on the carton carrier is provided with a cam follower roller 231 and supports a carton closure plate 232. The roller 231 rides in a box cam track 501 that extends around the entire carton forming apparatus at unvarying level except for offsets for closing the lower end of the carton as will be described hereinafter. The slide 226 supports a plate 502 which has a central slot in which a roll 503 is rotatably supported. The surface of the roll 503 projects above the surface of the plate 502. The plate 502 supports uprights 504 between which a carton closure sub-plate 506 is supported by resting on the roll 503 near its forward edge, and by having laterally extending pins 507 which mount rollers 508 that are confined in slots 509 in the uprights 504 that are slanted slightly clockwise from vertical as viewed in FIGS. 14 and 40 to 43. The sub-plate 506 supports the carton closure plate 232 yieldably, by means of a compression spring 511 that is confined in confronting annular grooves in the upper surface of plate 506 and the lower surface of carton closure plate 232. Spring loading (not shown) operating between the plate 502 and the carton closure sub-plate 506 urges the latter upwardly at its righthand end as viewed in FIG. 14 to present the rolls 508 at the upper ends of the slots 509. At its lefthand end the plate 502 (FIG. 14) has a vertical extension 515 (FIGS. 13 and 14) which stabilizes the closure plate 232 by fitting into a slot 510 on the underside of that plate.

Behind the carton closure plate 232 the lower slide member 226 supports a pair of spaced posts 512 on which a block 513 is slidably mounted for vertical movement. An arm 514 that is attached to the slidable block 513 mounts a cam follower roller 516 which cooperates with a cam surface to be identified hereinafter. A tension spring 517 has one end connected to a spring post on the arm 514 and the other end connected to the slide member 226. The slideable block 513 supports a flexible spring arm 520 which has as its purpose deflection of the lower carton closure panel into position to have its inner surface heated preparatory to closure of the bottom of the carton as will also be described hereinafter. To summarize the foregoing, slide member 226 is movable upwardly and downwardly on the carton carrier under the control of the box cam track 501, the slide block 513 being movable with it, and the latter being independently movable under the control of a cam surface which is engaged by the cam follower roller 516.

Figure 39:
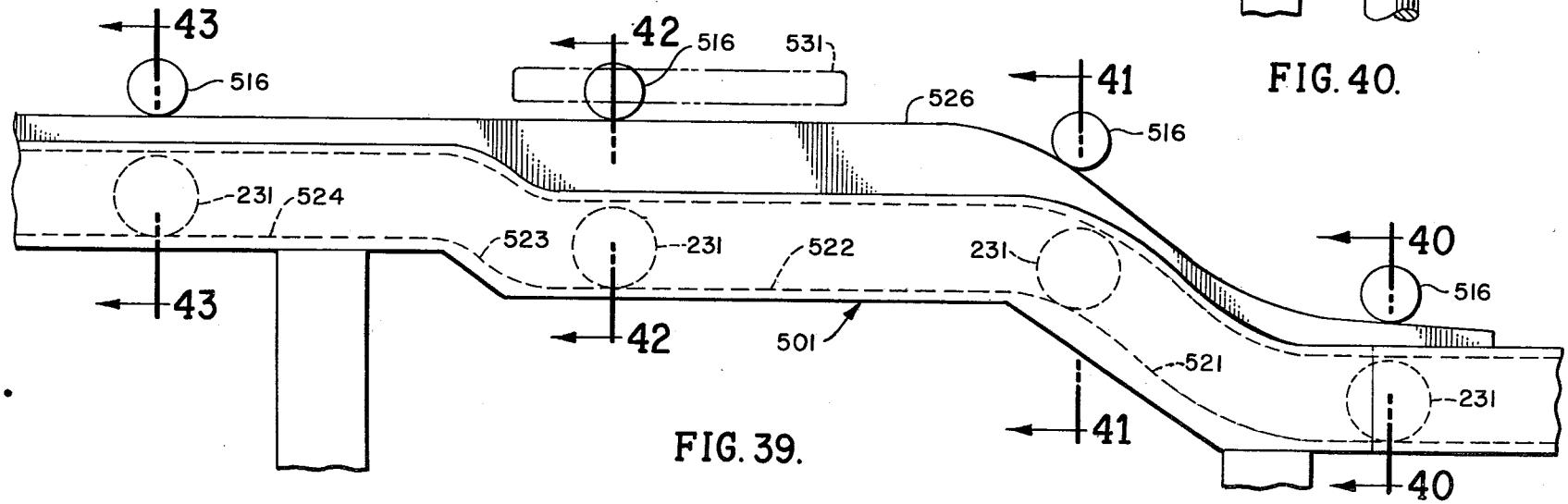
FIG. 39 is a schematic elevational view of the cams involved in the closing and sealing of the bottom of the carton.

Turning now to FIGS. 9 and 39, the box cam 501 is seen to have a first rise 521 from its lower-most or normal level, a dwell 522 at the top of the rise 521 and a second rise 523 to its upper-most dwell 524. The cam for operating the slide block 513 is the plate 526 which stands on edge behind the carton carriers.

FIGS. 40 to 43 are schematic elevational views partly in the section, corresponding generally to the lower part of FIG. 14 and showing the components of the lower slide member 226 in four different operative positions as related to the rises and dwells in the cam members 501 and 526 shown in FIG. 39 which is positioned below FIGS. 40 to 43. It will be understood that the views in FIGS. 40 to 43 are turned ninety degrees in a clockwise direction from the way they would appear if actually forming a part of FIG. 39 and cooperating with the cam members in that figure of the drawings. In order to relate FIGS. 40 to 43 to FIG. 39, there are in FIG. 39 multiple appearances of the cam follower rollers 231 and 516, each appearance representing the location of those cam follower rollers in relation to the cams 501 and 526 that present the lower slide member 226 and its slidable block 513 into positions shown in FIGS. 40 to 43.

Figure 40:
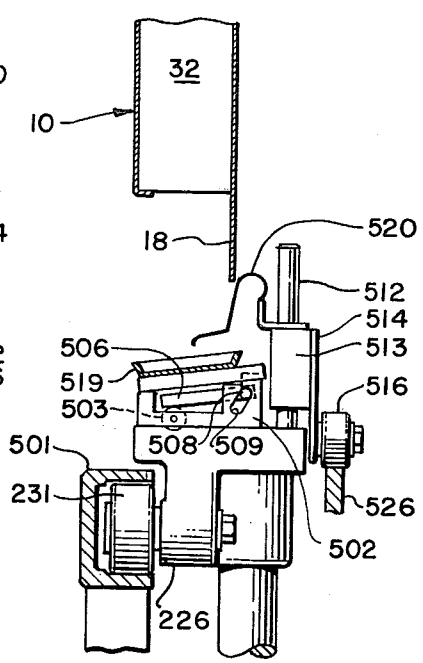
FIGS. 40 to 43 are elevational views, partly in section showing in sequence different operating positions of the carton bottom closing and sealing portion of the carton carrier.
Figure 41:
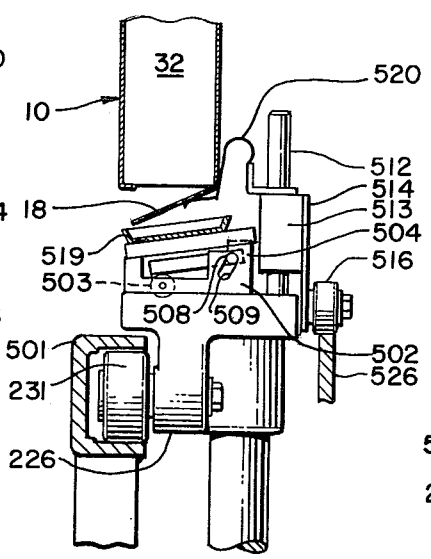

FIG. 40 shows the lower slide member 226 generally in its normal lowermost position but approaching the first rise or offset 521 in the box cam track 501 and just beginning the encounter with the cam plate 526. FIG. 40 also shows the mandrel 32 with the carton wrapped around it and with the lower carton closure panel 18 extending straight down from the carton blank since it has not yet been affected by any of the apparatus. As the cam follower roller 231 traverses the first rise or offset 521 in the box cam track 501, it is lifted to the position shown in FIG. 41. Because the slide block 513 is supported on the carton carrier slide 226, it rises with it and the spring finger 520 contacts the carton closure panel 18 and flexes it into angular confrontation with the lower end of the mandrel as shown in FIG. 41. As indicated in FIGS. 9 and 39 the cam plate 526 may have a rise corresponding to the rise or offset 521 in the box cam track 501 but this is not essential because the slide block 513 rises with the carton carrier slide 226 whether or not it is assisted by the cam plate 526 engaged by the cam follower roller 516.

FIG. 41 shows the lower slide member 226 substantially at the top of the first rise 521 in the cam track 501 but the roller 516 has not reached the top of the rise in the cam plate 526. The rising of the lower slide assembly 226 to the position shown in FIG. 41 has resulted in the flexing of the lower closure panel 18 of the carton into angular confrontation with the lower end of the mandrel 32, the flexing having been accomplished by the spring arm 520 carried by the slide block 513 on the lower slide assembly 226.

Figure 42:
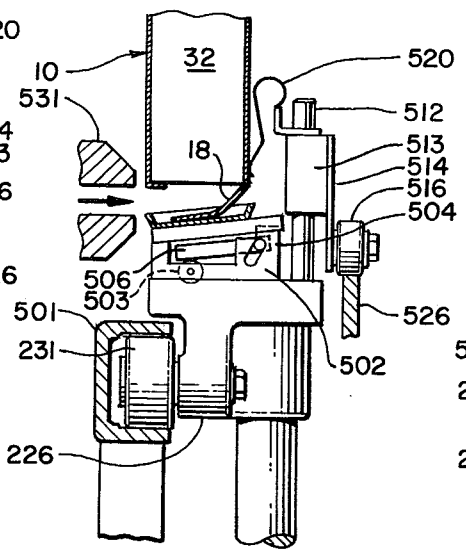
Figure 43:
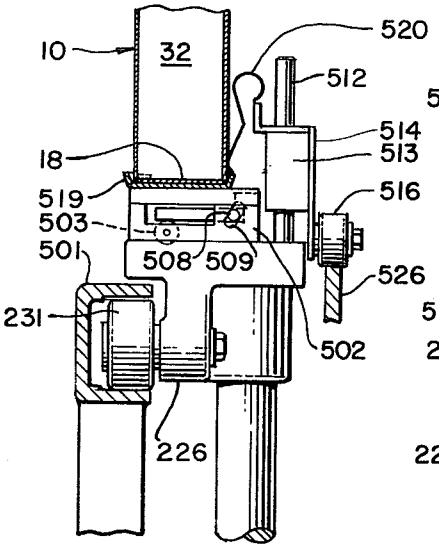

FIG. 42 shows the position of the lower slide assembly 226 when its cam follower roller 231 has completed its rise into the dwell 522 of the cam track 501, and the cam follower roller 516 that controls the slide block 513 has risen to the top of the cam plate 526. In the case of the slide block 513 it has lifted the spring arm 520 above the lower end of the mandrel 32 and its tip is resting against the side of the mandrel. In the case of the lower slide member 226 it has risen sufficiently to have engaged the lower carton closure panel 18 which is low pressed against the interior of a pan 519 that surmounts the closure plate 232 on the lower slide assembly 226.

HEATER FOR BOTTOM CLOSURE PANEL

Figure 26:
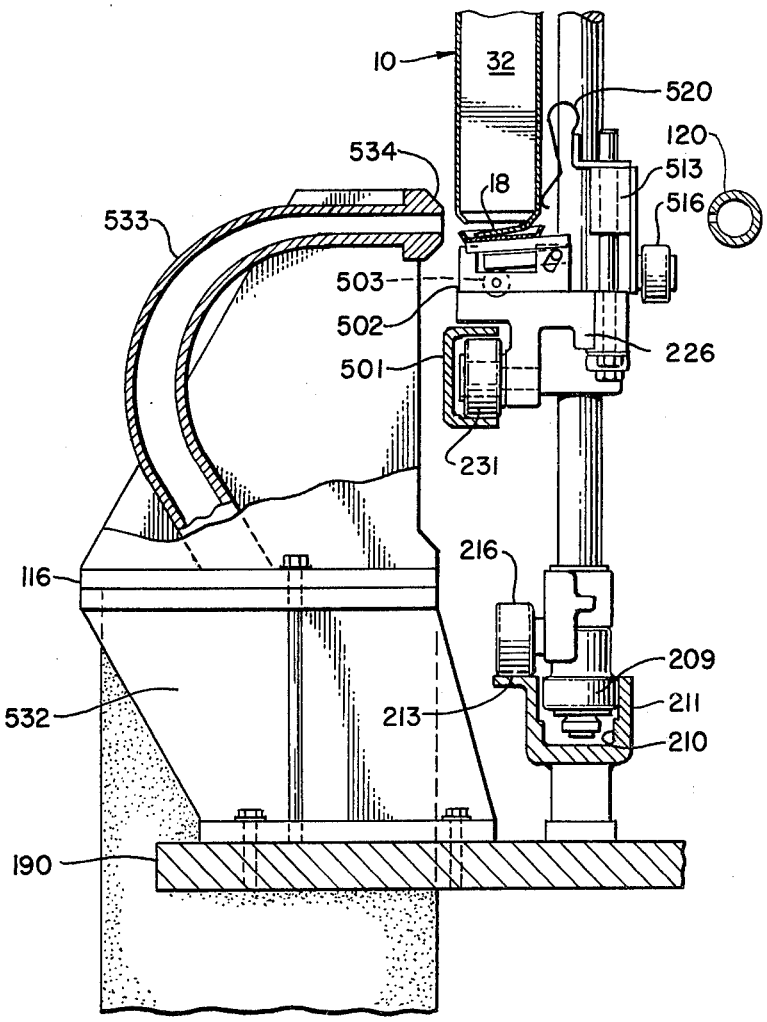
FIG. 26 is a side elevational view, partly in section, showing the heater for preparing the lower end of the carton for closure and sealing.

During most of the traversal of the dwell 522 in cam track 501 by the cam follower roller 231, the inner surface of the lower closure panel 18 and the outer surfaces of the closure sealing tabs 22 at the lower end of the carton are heated by the heater 116 (FIGS. 7, 9 and 26). The rectangle 531 in FIG. 39 is indicative of the location of the nozzle orifice of the heater 116 relative to the rises and dwells in the cam track 501.

The heater unit is shown in rear elevation in FIG. 9 and in side elevation, partly broken away, in FIG. 26. The heater 116 is mounted on the tabletop 190 and comprises a combustion chamber 532 from which rises a curved and flaring nozzle 533 which terminates in a long narrow horizontally disposed orifice 534 (FIG. 26). The curved nozzle places the orifice 534 in a position to deliver heat into the space between the lower closure panel 18 of the carton and the lower end of the mandrel 32. The combustion chamber 532 is supplied with a mixture of gaseous fuel and air from a supply line 536, and as in the case of the heater for the side seam the fuel mixture is adjusted to maintain a temperature of combustion products and air emerging from the orifice 534 in the nozzle 533 that will melt the polyethylene coating on the inner surface of the lower closure panel 18 and the outer surfaces of the sealing tabs 22 for sealing purposes, without charring the portions of the carton that are heated.

CLOSURE OF LOWER END OF CARTON

As the carton carrier 60 moves the lower end of the mandrel out of registry with the orifice 534 in the heater nozzle 533, the cam follower roller 231 rises along the rise 523 in the cam track 501 and into the dwell 524. This results in the raising of the lower slide assembly 226 on the carton carrier into the position shown in FIG. 43, which causes the closure plate 232 to press the lower closure panel 18 on the carton into contact with the sealing tabs 22 at the lower end of the carton. Viewing the mounting structure for the carton closure plate 232 as previously described with reference to FIG. 14, it will be apparent from the sloping attitude of the carton closure panel 232 as supported by the subplate 506 that a line contact of pressure occurs initially between the closure plate 232 and the lower end of the mandrel 32, after which the pressure plate 232 rocks clockwise about that line of pressure contact until it comes into a horizontal position exerting pressure against the entire lower end of the mandrel. By virtue of the guiding of the plate 506 that supports the closure plate 232 by its rollers 508 disposed in the slots 509, and the supporting of the plate 506 on the roller 503, the supporting plate 506 for the closure plate 232 will move downwardly and forwardly relative to the plate 502 and into a horizontal position, thus giving a slight forward motion to the closure plate 232 which, rubbing forwardly upon the outer surface of the carton lower closure panel 18, will assure that the panel is pressed smoothly flat against the lower end of the mandrel and into contact with the sealing tabs 22. The compression spring 511 which is disposed between the closure plate 232 and its operating subplate 506 provides a yield between the two plates so that a jamming of the closure plate 232 against the lower end of the carton and the mandrel 32 by the cam follower roller 231 riding in the box cam track 501, with possible resultant damage, shall not occur.

Reference is now made to FIG. 7, and in that figure to the previously identified vented duct 120 for delivering a blast of cold air against the lower end of the mandrel and the carton closure plates carried by the lower slide assembly 226 for cooling the lower end of the carton and completing the seal preparatory to withdrawing the carton closure plate 232 from contact with the lower end of the closed carton. The extent of the cooling duct 120 longitudinally of the apparatus is indicated in FIG. 7 and its location behind the carton carrier at the proper height to supply air to cool the sealed end of the carton is indicated in FIG. 26. The fact that the cooling air is blowing on the carton carrier from behind while the lower end of the carton is being heated does not interfere with that heating but alleviates to some extent heating of other parts of the apparatus.

Figure 11:
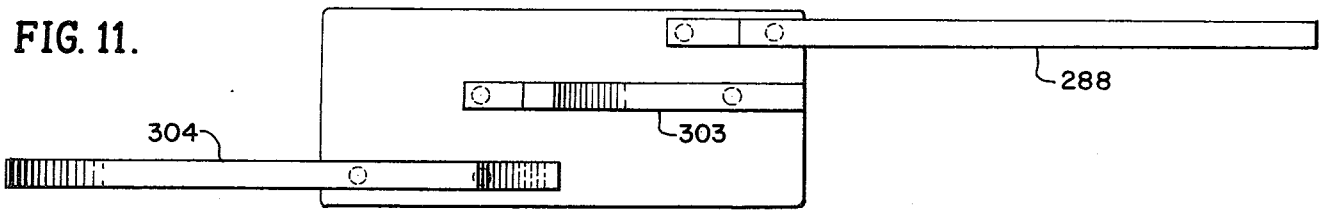
FIG. 11 is an elevational view taken generally on the line 11—11 of FIG. 10A.

About the time that the carton carrier moves out of registry with the cooling duct 120 the cam follower roller 287 on the carton blank holding plate 236 encounters a cam bar (not shown) corresponding with the cam bar 288 in FIGS. 10A and 11. It will be remembered that the cam bar 288 retracted the plate 236 to permit the mandrel 32 to descend, after which the plate clamped the carton blank 10 against the mandrel. A similar retraction of the plate 236 must occur to permit the lifting of the mandrel and the stripping of the carton from the mandrel. Thereafter the cam follower roller 226 on the slide structure that supports the mandrel encounters a rise in the box cam track 289 which lifts the mandrel, and with it the carton, a short distance. At about the same time that the mandrel is lifted the cam follower roller 231 in the box cam track 501 and the cam follower roller 516 riding the cam plate 526 encounter and traverse companion declines and both are lowered to their normal levels of travel, thus bringing the lower slide assembly 226 down to the level at which it travels across the front and around both ends of the apparatus. The result of these operations is that the lower end of the carton is lifted above, and the lower slide structure including the slides 216 and 513, is lowered, to accommodate the passage between them of carton carriers, to be described hereinafter, which will convey the cartons away from the carton forming apparatus.

DISENGAGEMENT OF CARTON FROM MANDREL

In the initial description of the carton blank carrier 60, reference was made to a plate 241 that is carried by the rods 202 and 203 of the carton blank carrier and that is seen in FIGS. 12 and 14 and also in FIG. 24. The plate 241 mounts, in any convenient manner such as by stand-off pins 541, a pair of upstanding posts 542. A slide block 543 is slidably mounted for vertical movement on the posts 542 and carries for affecting its sliding movement a cam follower roller 544. On its opposite side from the cam follower roller 544 the slide block 543 has a depending arm 546 at the lower end of which is mounted a stripper bail 547, the two arms of which face the leading and trailing side walls of the mandrel 32. The closeness of the side arms of the stipper bail 547 to the side of the mandrel 32 is such that when the arms of the bail encounter the upper end of a carton in the course of relative movement between the mandrel and the bail, the carton will be slid off the lower end of the mandrel.

Referring again to FIG. 9 the reference numeral 551 designates a suspended cam plate which is encountered by the cam follower roller 544 for the stripper bail slide block 543 in the course of travel of the carton carrier following the closure of the lower end of the carton. It will be noted in FIG. 9 that at about the time the cam follower roller 544 encounters the cam plate 551 to cause downward movement of the stripper bail 547 on the carton carrier, the cam follower roller 226 of the mandrel slide encounters a further rise in the box cam track 289 so that simultaneous lifting of the mandrel and lowering of the stripper bail 547 occurs and the carton is disengaged from the mandrel. The rise in the box cam track 289 brings the mandrel back to its initial position, and the cam plate 551 includes both a rise and a fall in the cam surface. Springs are required to restore the slide block 43 to its upper position against a stop disk 548 on one or both of the posts 542 and these may be compression springs 549 surrounding the posts 542 and resting on a stationary object such as the upper stand-off pins 541 that attach the posts 542 to the plate 241.

FIGS. 9 and 10B elaborate schematically upon the showing in FIG. 7 of a conveyor chain 130 passing in proximity to the point of release of cartons from the mandrel and provided with carton carriers spaced along the chain 130 in correspondence with the spacing of the carton blank carriers 60 in the carton forming apparatus for carrying the formed cartons to a point of utilization such as, for example, to a filling apparatus. The carton carrier is designated by the reference numeral 561 and may be of the type shown in copending application, Ser. No. 628,443 filed Nov. 3, 1975 by E. Alan Williams. The carton carrier 561 is comprised of two side walls 562 and 563 and a back wall 564. This leaves the carrier open on the side facing the cartons that are being discharged from the forming apparatus. One of the sides, as indicated in FIGS. 9 and 10B, the side 563, is pivotally mounted at its base and is provided with an outwardly extending arm 566 which carries a rotatably mounted roller 567. A stationarily mounted cam track 568 is provided with upwardly curved ends for lead-in and release purposes and as the carrier 561 is advanced, its roller comes under the stationary cam bar 568 and is depressed by it, thus swinging the wall 563 of the carrier outwardly to permit the carton to settle in the carrier. When the cam follower roller 567 runs free of the stationary cam rail 568, the side wall 563, which is spring biased to close, closes against the carton gripping it in the holder 561. There may also be provided a guide rail (not shown) to engage the carton after it has settled into the carrier 561 and nudge it back into engagement with the back wall 564 of the carrier 561.

It will be understood that in schematic views, particularly such figures as FIGS. 7, 9, 10A and 10B, the presence and utilization, rather than the actual positions, of such components as the singulator 62, the straw applicator 68, the side seam ceiling tab crimper 70, the bottom sealing tab crimper 110, the heater for the bottom of the carton, the cold air supply duct 120, and the sprocket 132 is indicated. It is to be understood that each will be positioned to operate with maximum effectiveness and without competition among them. The disclosed structure affords suitable positions for all components, and those positions are generally the ones shown in the drawings.

What is claimed is:

1. In an apparatus for forming a carton from a blank comprising a plurality of side wall panel elements delineated by scoring established bending lines and having associated with the ends of said side wall panel elements either an end sealing tab element or an end closure panel element delineated by scoring established bending lines and arranged to provide at least one end closure panel at each end of the carton, and further having in association with the side an end one of said side wall panel elements a side seam sealing tab element delineated by a scoring establishing a bending line;

a plurality of carton blank carriers each having means for retentively supporting a carton blank;

a movable mandrel associated with each of said carton blank carriers, said mandrel being movable relative to its associated carton blank carrier;

means for moving the mandrel into a covering relation to one of the side wall panel elements and to one of the end closure panels of a supported carton blank;

a work station for flexing said side seam sealing tab element about its bending line scoring;

a work station for folding around the mandrel at the side wall panel bending lines a blank supported by a carrier to the extent that the flexed side seam sealing tab element associated with an end one of the side wall panel elements of the blank is spacedly confronted by the other end of one of the side wall panel elements;

holding means associated with said carrier for holding said blank folded around the mandrel with the spacedly confronting elements in their spacedly confronting attitudes;

means for conditioning confronting blank elements for permanent adhesive interengagement;

means for causing said holding means to close one of said confronting blank elements against the other whereby to seal them together to form of said blank an open-ended tube;

a work station for flexing the end-sealing tab element at one and the same end of each side wall panel element provided with such a tab inwardly of the openended tube;

means associated with said carrier for flexing the end closure panel element at the end of the blank having its end sealing tab elements flexed to bring said end closure panel element into spaced confrontation with said flexed end-sealing tab elements;

means for causing said end closure panel element flexing means to close said end closure panel element against said end sealing tab elements to seal them together to effect closure of one end of said tube;

means for separating said mandrel from said tube and said tube from the carrier; and transport means for transporting said carriers into successive and progressive cooperation with said work stations, said mandrel being movable relative to said transport means.

2. Apparatus in accordance with claim 1 wherein:

the blank-holding work station includes a stationary barrier member closely adjacent to the path of travel of the outwardly facing surface of the mandrel for deflecting a blank which has its leading edge protruding beyond the plane of the outwardly facing surface of the mandrel and for flexing the blank into at least closely confronting relation to the outwardly facing surface of the mandrel.

3. Apparatus in accordance with claim 2 including:

means for flexing the last and trailing side wall panel element of the blank into angular confrontation with the trailing surface of the mandrel.

4. Apparatus in accordance with claim 3 wherein:

the means for flexing the last and trailing side wall panel element of the blank comprises a power driven rotary member having fingers the tips of which cross and recross the path of travel of the outwardly facing surface of the mandrel relatively closely following the mandrel and which in their travel in overlapping relation to the mandrel engage the last and trailing side wall panel element and flex it into angular confrontation with the trailing face of the mandrel.

5. Apparatus in accordance with claim 4 wherein:

said rotary member includes at least one component element the circle of rotation of which relatively closely approaches tangency with the path of travel of the outwardly facing surface of the mandrel and which precedes the fingers in the direction of rotation to closely confine the blank in proximity to the outwardly facing surface of the mandrel during the flexing of the last and trailing side wall panel of the blank by the fingers.

6. Apparatus in accordance with claim 4 including:

means for coordinating the operation of said power driven rotary member with the operation of the transport means in a manner to produce identical operational cycles of the rotary member relative to the passing carton blank carriers.

7. Apparatus in accordance with claim 2 wherein the blank holding means is presentable in angular confronting relation to the trailing face of the mandrel for holding the last and trailing side wall panel element of the blank following the flexing of that side wall panel into that attitude.

8. Apparatus in accordance with claim 7 including means associated with said holding means for overlapping engaging the blank generally at the line of bending of the last and trailing side wall panel thereof around the mandrel and thereby maintaining contact between the blank and the outwardly facing surface of the mandrel.

9. Apparatus in accordance with claim 7 wherein:

the holding means comprises a member pivotally mounted on each blank carrier; and a plate member supported by said pivotally mounted member for face-wise movement by the pivotally mounted member into angular confrontation with the trailing face of the mandrel.

10. In an apparatus for forming a carton from a foldable blank of sheet material comprising a portion representing a plurality of side wall panel elements:

a plurality of carton blank carriers arranged in a sequential succession, each of said carriers having means for retentatively supporting a carton blank;

a mandrel associated with each of said carton blank carriers;

means for presenting the mandrel in covering relation to one of said side wall panel elements of a supported blank with all of the remaining side wall panel elements forming a leading portion protruding beyond the plane of the outwardly facing surface of the mandrel;

at least one work station;

transport means for sequentially transporting said carriers into cooperation with said work station;

blank bending means associated with the preceding carrier in said sequential succession for forming an initial bend in said blank at the juncture between said leading portion and said outwardly facing surface of said mandrel; and blank folding means at said work station comprising a stationary barrier member closely adjacent to the path of travel of the outwardly facing surface of the mandrel for deflecting a blank at said initial bend and for flexing the blank into at least closely confronting relation to the outwardly facing surface of the mandrel.

11. Apparatus in accordance with claim 10 including:

means for flexing the last and trailing side wall panel element of the blank into angular confrontation with the trailing surface of the mandrel.

12. Apparatus in accordance with claim 11 wherein:

the means for flexing the last and trailing side wall panel element of the blank comprises a power-driven rotary member having fingers the tips of which cross and recross the path of travel of the outwardly facing surface of the mandrel relatively closely following the mandrel and which in their travel in overlapping relation to the mandrel engage the last and trailing side wall panel element and flex it into angular confrontation with the trailing face of the mandrel.

13. Apparatus in accordance with claim 12 wherein:

said rotary member includes at least one component element the circle of rotation of which relatively closely approaches tangency with the path of travel of the outwardly facing surface of the mandrel and which precedes the fingers in the direction of rotation to closely confine the blank in proximity to the outwardly facing surface of the mandrel during the flexing of the last and trailing side wall panel of the blank by the fingers.

14. Apparatus in accordance with claim 13 including:

means for coordinating the operation of said power-driven rotary member with the operation of the transport means in a manner to produce identical operational cycles of the rotary member relative to the passing carton blank carrier.

15. Apparatus in accordance with claim 12 including:

blank holding means presentable in angular confronting relation to the trailing face of the mandrel for holding the last and trailing side wall panel element of the blank following the flexing of that side wall panel into that attitude.

16. Apparatus in accordance with claim 15 including means associated with said holding means for overlappingly engaging the blank generally at the line of bending of the last and trailing side wall panel thereof around the mandrel and thereby maintaining contact between the blank and the outwardly facing surface of the mandrel.

17. Apparatus in accordance with claim 15 wherein:

the holding means comprises a member pivotally mounted on each blank carrier; and a plate member supported by said pivotally mounted member for face-wise movement by the pivotally mounted member into angular confrontation with the trailing face of the mandrel.

18. In an apparatus for forming a carton from a blank comprising a plurality of side wall panel elements delineated by scoring establishing bending lines and having associated with the ends of said side wall panel elements either an end sealing tab element or an end closure panel element delineated by scoring establishing bending lines and arranged to provide at least one end closure panel at each end of the carton, and further having in association with the side of an end one of said side wall panel elements a side seam sealing tab element delineated by a scoring establishing a bending line;

a plurality of carton blank carriers each having means for retentively supporting a carton blank;

a mandrel associated with each of said carton blank carriers;

means for presenting the mandrel in covering relation to one of the side wall panel elements of a supported carton blank;

a work station for flexing said side seam sealing tab element about its bending line scoring;

a work station for folding around the mandrel at the side wall panel bending lines a blank supported by a carrier to the extent that the flexed side seam sealing tab element associated with an end one of the side wall panel elements of the blank is spacedly confronted by the other end one of the side wall panel elements, said other one of the side wall panel elements being the last and trailing side wall panel element;

flexing means in said work station for flexing said trailing side wall panel element into an angular confrontation with the trailing surface of said mandrel, said flexing means comprising a power-driven rotary member having a finger which engages said trailing side wall panel element, said rotary member including at least one component element the circle of rotation of which relatively closely approaches tangency with the path of travel of the outwardly facing surface of the mandrel and which precedes said finger in the direction of rotation to closely confine the blank in proximity to the outwardly facing surface of the mandrel during the flexing of said trailing side wall panel element by said finger;

holding means associated with said carrier for holding said blank folded around the mandrel with the spacedly confronting elements in their spacedly confronting attitudes;

means for conditioning confronting blank elements for permanent adhesive interengagement;

means for causing said holding means to close one of said confronting blank elements against the other whereby to seal them together to form of said blank an open-ended tube;

a work station for flexing the end-sealing tab element at one and the same end of each side wall panel element provided with such a tab inwardly of the open-ended tube;

means associated with said carrier for flexing the end closure panel element at the end of the blank having its end sealing tab elements flexed to bring said end closure panel element into spaced confrontation with said flexed end-sealing tab elements;

means for causing said end closure panel element flexing means to close said end closure panel element against said end sealing tab elements to seal them together to effect closure of one end of said tube;

means for separating said mandrel from said tube and said tube from the carrier; and transport means for transporting said carriers into successive and progressive cooperation with said work stations.

19. In an apparatus for forming a carton from a foldable blank of sheet material comprising a portion representing a plurality of side wall panel elements:

at least one carton blank carrier having means for retentatively supporting a carton blank;

a mandrel associated with each of said carton blank carriers;

means for presenting the mandrel in covering relation to one of the side wall panel elements of a supported carton blank;

at least one work station;

transport means for transporting said carrier into cooperation with said work station; and blank folding means at said work station comprising a stationary barrier member closely adjacent to the path of travel of the outwardly facing surface of the mandrel for deflecting a blank which has its leading edge protruding beyond the plane of the outwardly facing surface of the mandrel and for flexing the blank into at least closely confronting relation to the outwardly facing surface of the mandrel; and rotary flexing means for flexing the last and trailing side wall panel element of the blank into an angular confrontation with the trailing surface of said mandrel, said flexing means comprising a power-driven rotary member having a finger which engages said trailing side wall panel element, said rotary member including at least one component element the circle of rotation of which relatively closely approaches tangency with the path of travel of the outwardly facing surface of the mandrel and which precedes said finger in the direction of rotation to closely confine the blank in proximity to the outwardly facing surface of the mandrel during the flexing of said trailing side wall panel element by said finger.

* * * * *